US008087772B2

(12) United States Patent
Jones et al.

(10) Patent No.: US 8,087,772 B2
(45) Date of Patent: Jan. 3, 2012

(54) IDENTIFICATION CARD PRINTER-ASSEMBLER FOR OVER-THE-COUNTER CARD ISSUING

(75) Inventors: Robert Jones, Andover, MA (US); Daoshen Bi, Boxborough, MA (US); Dennis Mailloux, Westminster, MA (US)

(73) Assignee: L-1 Secure Credentialing, Inc., Billerica, MA (US)

( * ) Notice: Subject to any disclaimer, the term of this patent is extended or adjusted under 35 U.S.C. 154(b) by 240 days.

(21) Appl. No.: 12/352,378

(22) Filed: Jan. 12, 2009

(65) Prior Publication Data

US 2010/0020151 A1 Jan. 28, 2010

Related U.S. Application Data

(62) Division of application No. 10/436,729, filed on May 12, 2003, now Pat. No. 7,824,029.

(60) Provisional application No. 60/379,704, filed on May 10, 2002, provisional application No. 60/379,646, filed on May 10, 2002.

(51) Int. Cl.
*B41J 2/01* (2006.01)
*B41J 3/00* (2006.01)

(52) U.S. Cl. ..... 347/104; 347/101; 347/2

(58) Field of Classification Search ..... 347/101, 347/104, 2, 4; 400/120.18; 156/351, 364, 156/521, 563; 399/342
See application file for complete search history.

(56) References Cited

U.S. PATENT DOCUMENTS

| | | | | |
|---|---|---|---|---|
| 3,758,970 | A | 9/1973 | Annenberg | 40/2.2 |
| 4,133,926 | A | 1/1979 | Vorrier et al. | |
| 4,621,271 | A | 11/1986 | Brownstein | 346/76 |
| 4,653,775 | A | 3/1987 | Rapheal et al. | 283/108 |
| 4,738,949 | A | 4/1988 | Sethi et al. | 503/227 |
| 5,024,989 | A | 6/1991 | Chiang et al. | 503/227 |
| 5,249,546 | A | 10/1993 | Pennelle | 116/234 |
| 5,261,987 | A | 11/1993 | Luening et al. | 156/235 |
| 5,674,334 | A * | 10/1997 | Instance | 156/64 |
| 5,763,868 | A | 6/1998 | Kubota et al. | |
| 5,764,263 | A * | 6/1998 | Lin | 347/101 |
| 5,783,024 | A | 7/1998 | Forkert | 156/351 |
| 5,841,886 | A | 11/1998 | Rhoads | |

(Continued)

FOREIGN PATENT DOCUMENTS

DE 4403513 A1 8/1995

(Continued)

OTHER PUBLICATIONS

U.S. Appl. No. 60/344,685, filed Dec. 24, 2001, Bi et al.

(Continued)

*Primary Examiner* — Stephen Meier
*Assistant Examiner* — Leonard S Liang
(74) *Attorney, Agent, or Firm* — Mintz, Levin, Cohn, Ferris, Glovsky and Popeo, P.C.

(57) ABSTRACT

The present invention relates to assembling identification documents in an over-the-counter issuing environment. In one implementation of the present invention, we provide an ink jet printer-based assembling system. An identification document substrate receives ink jet printed information. The printed substrate is laminated. In another implementation, a carrier web carries lamination pieces. Both the carrier web and the document substrate include form feed holes or other registration notches. The holes or notches are used to align the substrate with the lamination pieces, and to align a laminated document substrate for final cutting.

10 Claims, 12 Drawing Sheets

U.S. PATENT DOCUMENTS

| | | | | |
|---|---|---|---|---|
| 6,003,581 | A | 12/1999 | Aihara | 156/555 |
| 6,007,660 | A | 12/1999 | Forkert | 156/256 |
| 6,066,594 | A | 5/2000 | Gunn et al. | 503/227 |
| 6,122,403 | A | 9/2000 | Rhoads | |
| 6,159,327 | A | 12/2000 | Forkert | |
| 6,162,160 | A | 12/2000 | Oshima et al. | |
| 6,164,548 | A | 12/2000 | Curiel | |
| 6,173,901 | B1 | 1/2001 | McCannel | |
| 6,202,932 | B1 | 3/2001 | Rapeli | 235/491 |
| 6,206,292 | B1 | 3/2001 | Robertz et al. | |
| 6,244,514 | B1 | 6/2001 | Otto | 235/492 |
| 6,253,817 | B1 * | 7/2001 | Edwards et al. | 156/351 |
| 6,283,188 | B1 | 9/2001 | Maynard et al. | 156/521 |
| 6,312,858 | B1 | 11/2001 | Yacobucci et al. | |
| 6,340,725 | B1 | 1/2002 | Wang et al. | |
| 6,357,664 | B1 | 3/2002 | Zercher | |
| 6,533,325 | B1 * | 3/2003 | Steidinger | 283/105 |
| 6,536,497 | B2 * | 3/2003 | Cook | 156/362 |
| 6,555,213 | B1 | 4/2003 | Koneripalli et al. | |
| 6,614,914 | B1 | 9/2003 | Rhoads et al. | |
| 6,685,312 | B2 | 2/2004 | Klinefelter et al. | |
| 6,702,282 | B2 | 3/2004 | Pribula et al. | |
| 6,729,719 | B2 | 5/2004 | Klinefelter et al. | |
| 6,752,432 | B1 | 6/2004 | Richardson | |
| 6,758,616 | B2 | 7/2004 | Pribula et al. | |
| 6,817,530 | B2 | 11/2004 | Labrec et al. | |
| 6,827,277 | B2 | 12/2004 | Bloomberg et al. | |
| 6,843,422 | B2 | 1/2005 | Jones et al. | |
| 6,916,132 | B2 * | 7/2005 | Otsuka et al. | 400/621 |
| 6,942,331 | B2 | 9/2005 | Guillen et al. | |
| 7,196,813 | B2 | 3/2007 | Matsumoto | |
| 7,202,970 | B1 | 4/2007 | Maher et al. | |
| 7,344,325 | B2 | 3/2008 | Meier et al. | |
| 2001/0013395 | A1 * | 8/2001 | Pourmand et al. | 156/555 |
| 2002/0145652 | A1 | 10/2002 | Lawrence et al. | |
| 2002/0170966 | A1 | 11/2002 | Hannigan et al. | |
| 2003/0031340 | A1 | 2/2003 | Alattar et al. | |
| 2003/0038174 | A1 | 2/2003 | Jones | |
| 2003/0173406 | A1 | 9/2003 | Bi et al. | |
| 2003/0211296 | A1 | 11/2003 | Jones et al. | |
| 2003/0226897 | A1 | 12/2003 | Jones et al. | |
| 2003/0234286 | A1 | 12/2003 | Labrec et al. | |
| 2003/0234292 | A1 | 12/2003 | Jones | |
| 2004/0011874 | A1 | 1/2004 | Theodossiou et al. | |
| 2004/0074973 | A1 | 4/2004 | Duggan et al. | |

FOREIGN PATENT DOCUMENTS

| | | | |
|---|---|---|---|
| GB | 1472581 | | 5/1977 |
| JP | 03-239595 | A | 10/1991 |
| JP | 2000501661 | A | 2/2000 |
| JP | 2001-058485 | A | 3/2001 |
| WO | WO 82/04149 | | 11/1982 |
| WO | WO-99/15299 | A1 | 4/1999 |
| WO | WO-01/96112 | A1 | 12/2001 |
| WO | WO03/096258 | | 11/2003 |

OTHER PUBLICATIONS

U.S. Appl. No. 60/358,321, filed Feb. 19, 2002, Munday et al.

U.S. Appl. No. 60/379,646, filed May 10, 2002, Mailloux et al.

U.S. Appl. No. 60/379,704, filed May 10, 2002, Bi et al.

U.S. Appl. No. 60/421,254, filed Oct. 25, 2002, Rhoads et al.

U.S. Appl. No. 60/418,762, filed Oct. 15, 2002, Rhoads et al.

U.S. Appl. No. 60/410,544, filed Sep. 13, 2002, Haigh et al.

U.S. Appl. No. 60/418,129, filed Oct. 11, 2002, Howard et al.

U.S. Appl. No. 60/429,501, filed Nov. 26, 2003, Howard et al.

U.S. Appl. No. 60/447,502, Feb. 13, 2003, Haigh et al.

U.S. Appl. No. 60/451,840, filed Mar. 3, 2003, Levy.

U.S. Appl. No. 60/459,284, filed Mar. 31, 2003, Jones.

International Search Report, PCT/US03/15095.

Examiner's Report issued by the Canadian Patent Office on Nov. 10, 2009 in Canadian Application 2,482,834.

Japanese Unexamined Patent Application Publication No. 03-239595, dated Oct. 25, 1991.

Japanese Unexamined Patent Application Publication No. 2001-058485, dated Mar. 6, 2001.

Notice of Reason for Rejection issued by the Japanese Patent Office Oct. 27, 2009, Japanese Application No. 2004-524001JP.

Notice of Reasons for Rejection issue by the Japanese Patent Office Nov. 4, 2009, Japanese Patent Application No. 2004-504171.

Supplemental European Search Report dated Nov. 13, 2009.

International Search Report, PCT/US03/15095, Mailed Mar. 25, 2004.

Notice of Reasons for Rejection; Dated Oct. 27, 2009 for Japanese Patent Application No. P2004-503267.

* cited by examiner

IDENTIFICATION CARD PRINTER-ASSEMBLER FOR OVER-THE-COUNTER CARD ISSUING

RELATED APPLICATION DATA

This application is a divisional application of U.S. patent application Ser. No. 10/436,729, filed May 12, 2003, now U.S. Pat. No. 7,824,029 which in turn claims the priority of the following U.S. Provisional Applications:

- Identification Card Printer-Assembler For Over-The-Counter Card Issuing (Application No. 60/379,646, Inventors: Dennis Mailloux, Daoshen Bi and Robert Jones), filed May 10, 2002; and
- Application of pigmented jet inks to ID cards (Application No. 60/379,704, Inventors Daoshen Bi, Dennis Mailloux, and Robert Jones), filed May 10, 2002, the contents of all of which are hereby incorporated by reference in their entireties.

This application is also related to the following U.S. patent applications:

- Use of Pearlescent and Other Pigments to Create Security Documents (application Ser. No. 09/969,020, Inventors Bentley Bloomberg and Robert L. Jones, filed Oct. 2, 2001);
- Identification Card Printed With Jet Inks and Systems and Methods of Making Same (application Ser. No. 10/289,962, Inventors Robert Jones, Dennis Mailloux, and Daoshen Bi, filed Nov. 6, 2002);
- Contact Smart Cards Having a Document Core, Contactless Smart Cards Including Multi-Layered Structure, PET-Based Identification Document, and Methods of Making Same (application Ser. No. 10/329,318, filed Dec. 23, 2002—Inventors Robert Jones, Joseph Anderson, Daoshen Bi, Thomas Regan, and Dermis Mailloux,);
- Ink with Cohesive Failure and Identification Document Including Same (application Ser. No. 10/329,315, filed Dec. 23, 2002—Inventors Robert Jones and Bentley Bloomberg);
- Laser Engraving Methods and Compositions, and Articles Having Laser Engraving Thereon (application Ser. No. 10/326,886, filed Dec. 20, 2002—Inventors Brian Labrec and Robert Jones);
- Multiple Image Security Features for Identification Documents and Methods of Making Same (application Ser. No. 10/325,434, filed Dec. 18, 2002—Inventors Brian Labrec, Joseph Anderson, Robert Jones, and Danielle Batey);
- Covert Variable Information on Identification Documents and Methods of Making Same (application Ser. No. 10/330,032, filed Dec. 24, 2002—Inventors: Robert Jones and Daoshen Bi);
- Systems, Compositions, and Methods for Full Color Laser Engraving of ID Documents (application Ser. No. 10/330,034, filed Dec. 24, 2002—Inventor Robert Jones);
- Laser Etched Security Features for Identification Documents and Methods of Making Same (application Ser. No. 10/330,033, filed Dec. 24, 2002—Inventors George Theodossiou and Robert Jones).
- Image Processing Techniques for Printing Identification Cards and Documents (application Ser. No. 10/411,354, filed Apr. 9, 2003—Inventors Chuck Duggan and Nelson Schneck)

The present invention is also related to the following provisional applications:

- Identification Document and Related Methods (Application No. 60/421,254,—Inventors: Geoff Rhoads, et al);
- Identification Document and Related Methods (Application No. 60/418,762,—Inventors: Geoff Rhoads, et al);
- Shadow Reduction System and Related Techniques for Digital Image Capture (Application No. 60/410,544, filed Sep. 13, 2002—Inventors: Scott D. Haigh and Tuan A. Hoang).
- Systems and Methods for Recognition of Individuals Using Combination of Biometric Techniques (Application No. 60/418,129, filed Oct. 11, 2002—Inventors James V. Howard and Francis Frazier);
- Systems and Methods for Managing and Detecting Fraud in Image Databases Used With Identification Documents (Application No. 60/429,501, filed Nov. 26, 2003—Inventors James V. Howard and Francis Frazier);
- Enhanced Shadow Reduction System and Related Technologies for Digital Image Capture (Application No. 60/447,502, filed Feb. 13, 2003—Inventors Scott D. Haigh, Tuan A. Hoang, Charles R. Duggan, David Bohaker, and Leo M. Kenen);
- Integrating and Enhancing Searching of Media Content and Biometric Databases (Application No. 60/451,840, filed Mar. 3, 2003);
- Optically Variable Devices with Embedded Data for Authentication of Identity Documents (Application No. 60/459,284, filed Mar. 31, 2003—Inventor Robert Jones);
- Optically Variable Devices with Encrypted Embedded Data for Authentication of Identity Documents (Application No. 60/463,660, filed Mar. 31, 2003—Inventors Robert Jones and Leo Kenen); and
- Image Processing Techniques for Printing Identification Cards and Document (Application no. 60/463,659, filed Mar. 31, 2003 Inventors Robert Jones and Brian Labrec.

Each of the above U.S. Patent documents is herein incorporated by reference in its entirety. The present invention is also related to U.S. patent application Ser. No. 09/747,735, filed Dec. 22, 2000, 09/602,313, filed Jun. 23, 2000, and Ser. No. 10/094,593, 10 filed Mar. 6, 2002, U.S. Provisional Patent Application No. 60/358,321, filed Feb. 19, 2002, as well as U.S. Pat. No. 6,066,594. Each of the above U.S. Patent documents is herein incorporated by reference.

TECHNICAL FIELD

The present invention generally relates to identification and security documents, and in particular, relates to identification document printing and assembly systems and methods.

BACKGROUND

Identification Documents

Identification documents (hereafter "ID documents") play a critical role in today's society. One example of an ID document is an identification card ("ID card"). ID documents are used on a daily basis—to prove identity, to verify age, to access a secure area, to evidence driving privileges, to cash a check, and so on. Airplane passengers are required to show an ID document during check in, security screening, and prior to boarding their flight. In addition, because we live in an ever-evolving cashless society, ID documents are used to make payments, access an ATM, debit an account, or make a payment, etc.

(For the purposes of this disclosure, ID documents are broadly defined herein, and include, e.g., credit cards, bank cards, phone cards, passports, driver's licenses, network access cards, employee badges, debit cards, security cards, visas, immigration documentation, national ID cards, citizenship cards, social security cards, security badges, certificates, identification cards or documents, voter registration cards, police ID cards, border crossing cards, legal instruments, security clearance badges and cards, gun permits, gift certificates or cards, membership cards or badges, etc., etc. Also, the terms "document," "card," "badge" and "documentation" are used interchangeably throughout this patent application.).

Many types of identification cards and documents, such as driving licenses, national or government identification cards, bank cards, credit cards, controlled access cards and smart cards, carry thereon certain items of information which relate to the identity of the bearer. Examples of such information include name, address, birth date, signature and photographic image; the cards or documents may in addition carry other variant data (i.e., data specific to a particular card or document, for example an employee number) and invariant data (i.e., data common to a large number of cards, for example the name of an employer). All of the cards described above will hereinafter be generically referred to as "ID documents".

In the production of images useful in the field of identification documentation, it is oftentimes desirable to embody into a document (such as an ID card, drivers license, passport or the like) data or indicia representative of the document issuer (e.g., an official seal, or the name or mark of a company or educational institution) and data or indicia representative of the document bearer (e.g., a photographic likeness, name or address). Typically, a pattern, logo or other distinctive marking representative of the document issuer will serve as a means of verifying the authenticity, genuineness or valid issuance of the document. A photographic likeness or other data or indicia personal to the bearer will validate the right of access to certain facilities or the prior authorization to engage in commercial transactions and activities.

Identification documents, such as ID cards, having printed background security patterns, designs or logos and identification data personal to the card bearer have been known and are described, for example, in U.S. Pat. No. 3,758,970, issued Sep. 18, 1973 to M. Annenberg; in Great Britain Pat. No. 1,472,581, issued to G. A. O. Gesellschaft Fur Automation Und Organisation mbH, published Mar. 10, 1976; in International Patent Application PCT/GB82/00150, published Nov. 25, 1982 as Publication No, WO 82/04149; in U.S. Pat. No. 4,653,775, issued Mar. 31, 1987 to T. Raphael, et al.; in U.S. Pat. No. 4,738,949, issued Apr. 19, 1988 to G. S. Sethi, et al.; and in U.S. Pat. No. 5,261,987, issued Nov. 16, 1993 to J. W. Luening, et al. All of the aforementioned documents are hereby incorporated by reference. Laminated ID documents are used as certificates of citizenship, identification cards, driver's licenses, member cards, passports, transaction cards, national identification cards, etc., etc., etc Printing Information onto ID Documents The advent of commercial apparatus (printers) for producing dye images by thermal transfer has made relatively commonplace the production of color prints from electronic data acquired by a video camera. In general, this is accomplished by the acquisition of digital image information (electronic signals) representative of the red, green and blue content of an original, using color filters or other known means. These signals are then utilized by a printer having a plurality of small heating elements (e.g., pins) for imagewise heating of each of a series of donor sheets (respectively, carrying sublimable cyan, magenta and yellow dye). The donor sheets are brought into contact with an image-receiving element (which can, for example, be a substrate) which has a layer for receiving the dyes transferred imagewise from the donor sheets. Thermal dye transfer methods as aforesaid are known and described, for example, in U.S. Pat. No. 4,621,271, issued Nov. 4, 1986 to S. Brownstein and U.S. Pat. No. 5,024,989, issued Jun. 18, 1991 to Y. H. Chiang, et al. Each of these patents is hereby incorporated by reference.

Dye diffusion thermal transfer printing ("D2T2") and thermal transfer (also referred to as mass transfer printing) are two printing techniques that have been used to print information on identification cards. For example, D2T2 has been used to print images and pictures, and thermal transfer has been used to print text, bar codes, and single color graphics.

D2T2 is a thermal imaging technology that allows for the production of photographic quality images. In D2T2 printing, one or more thermally transferable dyes (e.g., cyan, yellow, and magenta) are transferred from a donor, such as a donor dye sheet or a set of panels (or ribbons) that are coated with a dye (e.g., cyan, magenta, yellow, black, etc.) to a receiver sheet (which could, for example, be part of an ID document) by the localized application of heat or pressure, via a stylus or thermal printhead at a discrete point. When the dyes are transferred to the receiver, the dyes diffuse into the sheet (or ID card substrate), where the dyes will chemically be bound to the substrate or, if provided, to a receptor coating. Typically, printing with successive color panels across the document creates an image in or on the document's surface. D2T2 can result in a very high printing quality, especially because the energy applied to the thermal printhead can vary to vary the dye density in the image pixels formed on the receiver, to produce a continuous tone image. D2T2 can have an increased cost as compared to other methods, however, because of the special dyes needed and the cost of D2T2 ribbons. Also, the quality of D2T2-printed image may depend at least on an ability of a mechanical printer system to accurately spatially register a printing sequence, e.g., yellow, magenta, cyan, and black.

Another thermal imaging technology is thermal or mass transfer printing. With mass transfer printing, a material to be deposited on a receiver (such as carbon black (referred to by the symbol "K")) is provided on a mass transfer donor medium. When localized heat is applied to the mass transfer donor medium, a portion (mass) of the material is physically transferred to the receiver, where it sits "on top of" the receiver. For example, mass transfer printing often is used to print text, bar codes, and monochrome images. Resin black mass transfer has been used to print grayscale pictures using a dithered gray scale, although the image can sometimes look coarser than an image produced using D2T2. However, mass transfer printing can sometimes be faster than D2T2, and faster printing can be desirable in some situations.

Printing of black ("K") can be accomplished using either D2T2 or mass transfer. For example, black monochrome "K" mass transfer ribbons include Kr (which designates a thermal transfer ribbon) and Kd (which designates dye diffusion).

Both D2T2 and thermal ink have been combined in a single ribbon, which is the well-known YMCK (Yellow-Magenta-Cyan-Black) ribbon (the letter "K" is used to designate the color black in the printing industry). Another panel containing a protectant ("P") or laminate (typically a clear panel) also can be added to the YMCK ribbon).

Manufacture and Printing Environments

Commercial systems for issuing ID documents are of two main types, namely so called "central" issue (CI), and so-called "on-the-spot" or "over-the-counter" (OTC) issue.

CI type ID documents are not immediately provided to the bearer, but are later issued to the bearer from a central location. For example, in one type of CI environment, a bearer reports to a document station where data is collected, the data are forwarded to a central location where the card is produced, and the card is forwarded to the bearer, often by mail. Another illustrative example of a CI assembling process occurs in a setting where a driver passes a driving test, but then receives her license in the mail from a CI facility a short time later. Still another illustrative example of a CI assembling process occurs in a setting where a driver renews her license by mail or over the Internet, then receives a drivers license card through the mail.

In contrast, a CI assembling process is more of a bulk process facility, where many cards are produced in a centralized facility, one after another. (For example, picture a setting where a driver passes a driving test, but then receives her license in the mail from a CI facility a short time later. The CI facility may process thousands of cards in a continuous manner.).

Centrally issued identification documents can be produced from digitally stored information and generally comprise an opaque core material (also referred to as "substrate"), such as paper or plastic, sandwiched between two layers of clear plastic laminate, such as polyester, to protect the aforementioned items of information from wear, exposure to the elements and tampering. The materials used in such CI identification documents can offer the ultimate in durability. In addition, centrally issued digital identification documents generally offer a higher level of security than OTC identification documents because they offer the ability to pre-print the core of the central issue document with security features such as "micro-printing", ultra-violet security features, security indicia and other features currently unique to centrally issued identification documents.

In addition, a CI assembling process can be more of a bulk process facility, in which many cards are produced in a centralized facility, one after another. The CI facility may, for example, process thousands of cards in a continuous manner. Because the processing occurs in bulk, CI can have an increase in efficiency as compared to some OTC processes, especially those OTC processes that run intermittently. Thus, CI processes can sometimes have a lower cost per ID document, if a large volume of ID documents are manufactured.

In contrast to CI identification documents, OTC identification documents are issued immediately to a bearer who is present at a document-issuing station. An OTC assembling process provides an ID document "on-the-spot". (An illustrative example of an OTC assembling process is a Department of Motor Vehicles ("DMV") setting where a driver's license is issued to person, on the spot, after a successful exam.). In some instances, the very nature of the OTC assembling process results in small, sometimes compact, printing and card assemblers for printing the ID document. It will be appreciated that an OTC card issuing process is by its nature can be an intermittent—in comparison to a continuous—process.

OTC identification documents of the types mentioned above can take a number of forms, depending on cost and desired features. Some OTC ID documents comprise highly plasticized poly(vinyl chloride) or have a composite structure with polyester laminated to 0.5-2.0 mil (13-51 .mu.m) poly (vinyl chloride) film, which provides a suitable receiving layer for heat transferable dyes which form a photographic image, together with any variant or invariant data required for the identification of the bearer. These data are subsequently protected to varying degrees by clear, thin (0.125-0.250 mil, 3-6 .mu.m) overlay patches applied at the printhead, holographic hot stamp foils (0.125-0.250 mil 3-6 .mu.m), or a clear polyester laminate (0.5-10 ml, 13-254 .mu.m) supporting common security features. These last two. types of protective foil or laminate sometimes are applied at a laminating station separate from the printhead. The choice of laminate dictates the degree of durability and security imparted to the system in protecting the image and other data.

As those skilled in the art know, ID documents such as drivers licenses can contain information such as a photographic image, a bar code (which may contain information specific to the person whose image appears in the photographic image, and/or information that is the same from ID document to ID document), variable personal information, such as an address, signature, and/or birthdate, biometric information associated with the person whose image appears in the photographic image (e.g., a fingerprint), a magnetic stripe (which, for example, can be on the a side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

An exemplary ID document can comprise a core layer (which can be pre-printed), such as a light-colored, opaque material (e.g., TESLIN (available from PPG Industries) or polyvinyl chloride (PVC) material). The core is laminated with a transparent material, such as clear PVC to form a so-called "card blank". Information, such as variable personal information (e.g., photographic information), is printed on the card blank using a method such as Dye Diffusion Thermal Transfer ("D2T2") printing also described in commonly assigned U.S. Pat. No. 6,066,594, which is incorporated herein by reference in its entirety. The information can, for example, comprise an indicium or indicia, such as the invariant or nonvarying information common to a large number of identification documents, for example the name and logo of the organization issuing the documents. The information may be formed by any known process capable of forming the indicium on the specific core material used.

To protect the information that is printed, an additional layer of transparent overlaminate can be coupled to the card blank and printed information, as is known by those skilled in the art. Illustrative examples of usable materials for overlaminates include biaxially oriented polyester or other optically clear durable plastic film.

FIGS. 1 and 2 illustrate a front view and cross-sectional view (taken along the A-A line), respectively, of an exemplary prior art OTC identification document 1. In FIG. 1, the prior art OTC ID) document 1 includes a photographic image 2, personal information 3, and a security pattern 3 (for example, a printed pattern comprising a tightly printed pattern of finely divided printed and unprinted areas in close proximity to each other, such as a fine-line printed security pattern as is used in the printing of banknote paper, stock certificates, and the like). If desired, the security pattern 4 can be part of different pattern designs (e.g., filigree, guilloche) and can be printed in different inks (e.g., UV ink).

Referring to FIG. 2, the prior art OTC ID document 1 comprises a pre-printed core 5 (such as, for example, white PVC material) that is, for example, about 30 mil thick. The core 5 is laminated with clear PVC material 6, which, by way of example, is about 1-5 mil thick. The composite of the core 5 and clear PVC material 6 form a so called "card blank" 7 that can be about 30 mils thick. Information 8 is printed on the card blank 7 using Dye Diffusion Thermal Transfer ("D2T2")

printing (which is described further below). To protect the information 8 printed by D2T2 printing, an additional layer of overlaminate 9 is coupled to the card blank 7 and D2T2 printing using, for example, 1 mil of adhesive (not shown).

One type of OTC identification document, available from the assignee of the present invention is a so-called "Desktop Security Card (DSC), which has a core layer (also referred to as "substrate") formed from a sheet of an opaque printable material, such as an opaque sheet of printable silica-filled polyolefin, such as the materials sold commercially by PPG Industries, Inc., Pittsburgh, Pa. under the Registered Trade Mark "TESLIN". In the currently fielded versions of the DSC card, printing of the ID document in OTC environments is achieved with D2T2 printers. Printing quality of the printed image may depend at least on an ability of a mechanical printer system to accurately register a printing sequence, e.g., yellow, magenta, cyan, and black. Cormonly assigned U.S. Pat. No. 6,066,594 describes this type of OTC identification document in greater detail, and the contents of this patent are incorporated hereto by reference in their entirety.

SUMMARY

Manufacturing Costs and Other Issues

Printing of ID documents in OTC environments is often achieved with D2T2 printers. The ribbons uses with such D2T2 printers can be quite expensive, and the card blanks printed with D2T2 (e.g., PVC or other more expensive card blanks) also can be expensive. Copending and commonly assigned U.S. provisional patent application Ser. No. 60/379,704, entitled Application of pigmented jet inks to ID cards and U.S. nonprovisional patent application Ser. No. 10/289,962, entitled "Identification Card Printed With Jet Inks and Systems and Methods of Making Same" provide information about inventive methods and techniques for using ink jet printing (which can be significantly less expensive than using D2T2 ribbons) to print on blank sheets (e.g., TESLIN sheets) that can then be laminated to protect the printing.

Presently available dye diffusion printing also can be expensive, especially as compared to the cost of presently available inkjet printers. Part of the expense is attributable to a short life span of the dye diffusion ribbons, e.g., the ribbons can only be used for a few prints (sometimes only one print) before they are depleted. This sometimes occurs because the printing of a single card may require a full set of the D2T2 color panels, resulting in a high percentage of unused (and, unfortunately, wasted) imaging materials. These systems also can diffuse dye to expensive PCV or other, more expensive substrates.

Still another important issue with OTC ID documents is their durability. Many ID documents, such as driver's licenses, can be subjected to environmental conditions, such as humidity, water, dirt, and heat that can cause significant damage to the laminate, images, and/or text on the card. Such environmental conditions reduce the useful life of the card, yet issuers often want cards with lifetimes of up to 10 years. Manufacturing ID documents with such long lifetime, using known techniques and materials, adds greatly to the cost of the card.

Yet another issue with OTC manufacturing of ID documents is efficiency. In some environments, the OTC card issuing process can be at times an intermittent process. Intermittent operation of the OTC assembling process sometimes results in waste of the raw materials used to form the ID documents. Wasted raw materials increase the cost per ID card. It is possible, however, that the OTC card assembling process can be continuous, or can have intermittent periods of continuous operation).

Because many issuers of ID documents are often under budgetary pressure to keep the cost of ID documents low, while still maintaining a high quality, durable card, it would be desirable to improve the design and/or manufacture of ID documents to reduce ID document cost while maintaining ID document quality and durability.

We have found that in OTC applications we can achieve excellent printing and durability results by using ink jet printing to print on a substrate sheet. In one embodiment, the substrate street comprises a microporous material, e.g., a TESLIN sheet. (TESLIN is a synthetic material available from PPG Industries, One PPG Place, Pittsburgh, Pa. 15272 U.S.A). The microporous material includes a plurality of voids, and, because of the affinity between the microporous material and the pigments in the ink jet ink, at least a portion of the ink jet ink fills the voids. The ink jet printed substrate is then preferably over laminated with, e.g., polyester laminates and then cut into a typical ID card size (e.g., conforming to an ISO standard). Our inventive methods and systems produce an ID document with superior durability and tamper resistance, yet is a lower cost solution, therefore yielding a superior product at lower cost.

Another aspect of the present invention is to use a so-called carrier web to carry and control the orientation of laminate patches in an ID document lamination process. The carrier web can be of a paper-based material. It will be appreciated that an OTC card issuing process is by its nature an intermittent—in comparison to a continuous—process. While so-called continuous roll laminating provides a fast and efficient method of card lamination in a central issue environment, the same continuous lamination process is not typically compatible with an intermittent process, due to poor material utilization. For example, consider a situation where only one card is produced in a run. Many inches (or even feet) of the roll lamination would be wasted since a subsequent card would not directly follow the first card. The use of a carrier web provides a unique method of using roll lamination in an intermittent card assembly environment with a high laminate yield.

In one implementation of the present invention we perforate the carrier web and/or substrate along a printing and/or laminating machine direction edge to provide a physical registration feature. Our perforation holes (or "form feed holes") can be used to reliably convey materials and to accurately register multiple card layers (laminate substrate—laminate) as the layers are combined to make a laminated ID document. In some implementations we place holes along two parallel directional edges of the web or substrate.

In one embodiment, we provide a system to intermittently assemble identification documents, the identification document comprising a substrate with a top surface and a bottom surface, the top and bottom surfaces being laminated, said system comprising a first ink jet printer, a conveyor, a second ink jet printer, a laminator, and a cutter. The first ink jet printer is operable to print first information on a top surface of a substrate sheet, said first ink jet printer including a print tray or input to receive the substrate sheet. The conveyor conveys the once printed substrate sheet from the first ink jet printer. The second ink jet printer receives the once printed substrate sheet from the conveyor, the once printed substrate sheet being conveyed in such a manner so as to position a bottom surface of the substrate sheet to receive second information from the second ink jet printer, the second ink jet printer being operable to print the second information on the bottom surface of the substrate sheet.

The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet. The cutter is operable to cut excess material from the laminated, twice printed substrate sheet, the cut, laminated twice printed substrate sheet forming the identification document.

In another embodiment, we provide another system to intermittently assemble identification documents, an identification document comprising a substrate with a top surface and a bottom surface, the top and bottom surfaces being laminated, said system comprising a first ink jet printer, a first conveyor, a second conveyor, and a laminator.

The first ink jet printer is operable to print first information on a top surface of a substrate sheet, said first ink jet printer including an input to receive the substrate sheet and an output from which a printed substrate sheet exits the first ink jet printer. The first conveyor conveys a once printed substrate sheet from the first ink jet printer output back to the first ink jet printer input, the first conveyor conveying the once printed substrate sheet so as to be positioned to receive printed information on a bottom surface of the substrate sheet, the top and bottom substrate surfaces being different surfaces, the first ink jet printer being operable to print second information on the bottom surface of the substrate sheet. The second conveyor conveys a twice-printed substrate sheet from the first ink jet printer output.

The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet. The cutter cuts excess material from the laminated, twice printed substrate sheet, the cut, laminated twice printed sheet forming the identification document.

In a further embodiment, we provide a system to intermittently assemble identification documents, an identification document comprising a substrate with a top surface and a bottom surface, the top and bottom surfaces being laminated, said system comprising first and second ink jet printers and a laminator.

The first ink jet printer is operable to print first information on a top surface of a substrate sheet. The second ink jet printer is operable to print second information on a bottom surface of a substrate sheet, the second ink jet printer being constructed and arranged relative to the first ink jet printer such that the substrate sheet can travel along a predetermined path and have its top side printed by the first ink jet printer and its bottom side printed by the second ink jet printer without having to change the orientation of the substrate along the predetermined path. The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet, the laminated, twice printed substrate sheet comprising the identification document. In a further embodiment, the first and second ink jet printers are constructed and arranged to print the substrate sheet at substantially the same time.

In still another embodiment, we provide a method of assembling an identification document, the assembled identification document including at least a substrate having a top surface and a bottom surface, the substrate being laminated.

A substrate having printing thereon is provided, the substrate sheet having been perforated or cut so as to include the outline of card. The card is separated from the substrate sheet, the card having a top surface and a bottom surface. A top laminate is provided so as to contact the card's top surface, and bottom laminate is provided so as to contact the card's bottom surface, said top laminate, substrate and bottom laminate forming a card sandwich, said providing laminates steps being preformed at a first station. The card sandwich is heated and pressed to facilitate lamination of the card sandwich at a second station, the second station being separate from the first station. The laminated card sandwich is cooled at a third station, the third station being separate from the first and second stations.

In a further embodiment, we provide a method of assembling an identification document in an intermittent assembling environment. Ink jet printing is controlled so as to print first information on a first surface of the document substrate and to print second information on a second surface of the document substrate, the second information including at least one set of data that is unique with respect to the first information. Lamination of the printed document substrate is controlled so as to provide a top laminate in contact with the first surface of the document substrate and to provide a bottom laminate in contact with the second surface of the document substrate. Alignment of the laminated document substrate is controlled through at least form feed holes placed along at least one of an edge of the document substrate and a carrier web that carries the top or bottom laminate, wherein the alignment relates to at least one of cutting, material registration and the placement of security features on the laminated document substrate.

In yet another embodiment, we provide system to produce an identification document from a substrate having first and second sides and comprising a predetermined material, the system comprising means for printing to the first side of the substrate, said means for printing operable to print the identification document using an ink having an affinity for the predetermined material, means for laminating at least one side of the identification document, and means for transferring the printed substrate to the means for laminating;

The foregoing and other features and advantages of the present invention will be even more readily apparent from the following Detailed Description, which proceeds with reference to the accompanying drawings.

BRIEF DESCRIPTION OF THE DRAWINGS

The drawings are not necessarily to scale, emphasis instead generally being placed upon illustrating the principles of the invention. In addition, in the figures, like numbers refer to like elements.

DETAILED DESCRIPTION

Figure 1:
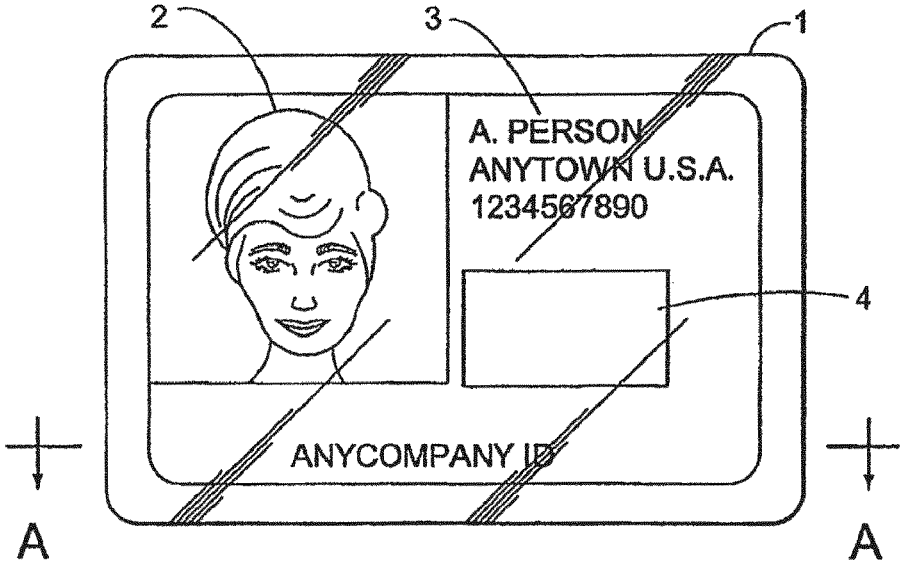
FIG. 1 is an illustrative example of a prior art identification document.

The following detailed description discloses multiple embodiments of our present invention. It should be appreciated that the disclosure found in one embodiment section can be readily combined with the disclosure found in another section.

In the foregoing discussion, the use of the word "card" is intended to include all types of ID documents. (For the purposes of this disclosure, the terms "document," "card," "badge" and "documentation" are used interchangeably. In addition, ID document shall include, without limitation, documents, magnetic disks, CD's, or any other suitable items that may record information, images, and/or other data, which may be associated with an object or other entity to be identified.)

While ink jet printers have been available for some time now, their use in ID card printing has been limited due to several factors. Common dye based inks, as traditionally used in ink jet printers, can lack the stability to resist fading over time or under prolonged exposure to sunlight. In laminated ID cards, it is preferred that ink that is deposited on a substrate (e.g., a TESLIN sheet) not interferes with the bonding of the protective laminates that are often coupled to the substrate. Any interference may defeat security provided by the laminates or long life of the resultant ID document.

The inventors have found that dye-based ink jet inks require a so-called receiving layer (or thin coating) to be applied to the ID document substrate in order to produce a high quality print appearance. Conventional receiving layers have water absorptive characteristics that can weaken the ID card's physical integrity. For example, a card substrate that is treated with a receiving layer absorbs water, particularly at the card's edges. Absorbing water can have disastrous effects—the card can swell or warp, the laminate can peel away, a weakness point can form providing an intrusion entry point, and the printed ink can be blurred or even lost. The inventors of the instant application also have discovered that a receiving layer often weakens the bond between the substrate and laminate.

Another weakness of conventional dye based ink jet inks is the mobility of the inks in the document substrate. Often, after application to a document substrate, dye-based ink jet ink will penetrate through the entire thickness of the substrate, particularly when a receiving layer is not applied to the substrate. Ink mobility has at least two negative results. First, the ink visible on the surface of the document substrate is reduced, leading to a "washed out" image. Second, in a worst-case scenario, ink printed on a front surface of the substrate becomes visible on a back surface of the substrate.

We have discovered that the use of pigmented ink jet inks substantially eliminates or at least significantly reduces most of these issues, making such pigmented ink jet inks suitable for printing information to ID card substrates. The light and aging stability of such pigmented inks are excellent. We have also determined that a receiving layer is not required when printing with these pigmented inks, making laminate bonds to the printed substrate acceptable, while maintaining excellent moisture resistance. The pigment particles exhibit a controlled level of penetration into the substrate, such as a microporous polyethylene-polymer containing materials such as a TESLIN (manufactured by PPG Industries, Inc., of Pittsburgh, Pa.) substrate, producing excellent quality, high-density images, with little to no bleed though to the back surface of the substrate. In particular, the instant inventors have discovered

- The light and aging stability of such pigments inks are excellent.
- A receiving layer is not required when printing a microporous core such as a TESLIN sheet with pigment inks. Microporous core materials such as TESLIN tend to filter pigment particles out of pigmented ink leaving, in some instances, the vast majority of the ink's pigment close to the surface. Some penetration into the pores of the TESLIN does appear to occur, which aids in locking the pigment to the substrate. However, the pigmented ink penetration has been observed to be slight in comparison to traditional dye inks. The resulting bond strength of the laminate to the microporous material is excellent, and appears to be substantially unaffected by moisture.
- Since the level of penetration of the pigment into the substrate can be limited, bleed through from a front surface to a back surface of the substrate has not been observed.
- Attempts at delamination can result in showing obvious evidence that tampering has occurred. For example, if laminate is removed from a TESLIN-based substrate printed with pigmented ink jet inks, either he TESLIN can fracture cohesively (down the thickness of the material) or the ink fractures cohesively (most ink staying with the laminate and the remainder with the TESLIN) or a combination of these two modes. These failure modes make alteration quite obvious, photo replacement or data changing very difficult, and relamination impossible without adding an adhesive layer.

We believe that our use of pigmented ink jet inks also may have application in central issue manufacturing of ID documents as well as over the counter manufacturing of ID documents, especially in situations where the resolution of ink jet printers surpasses that of laser printers used to print on TESLIN for the purpose of making ID cards. More details about our inventive use of pigmented inks can be found in our commonly assigned U.S. patent application Ser. No. 10/289,962, entitled "Identification Card Printed with Jet Inks and Systems and Methods of Making Same", the contents of which are incorporated herein by reference.

Figure 3:
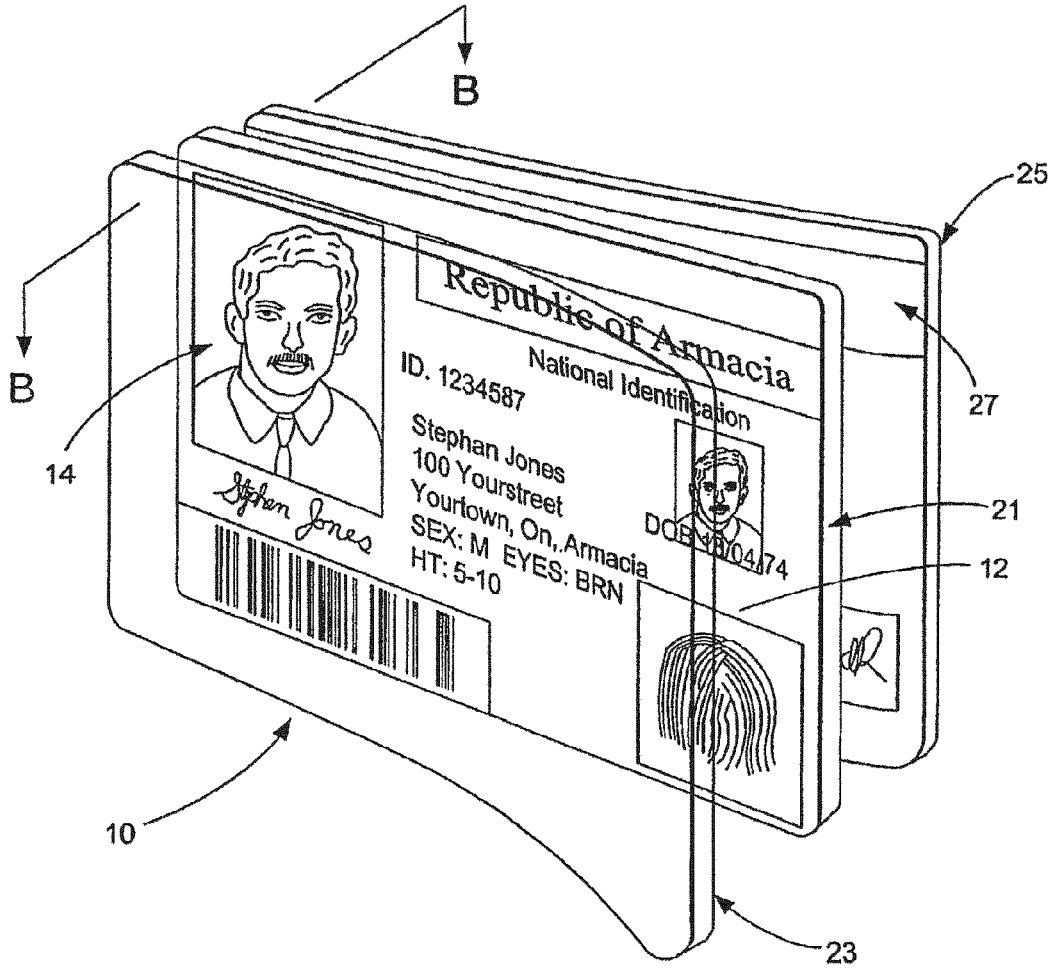
FIG. 3 is an illustrative example of an identification document in accordance with an embodiment of the invention.
Figure 4:
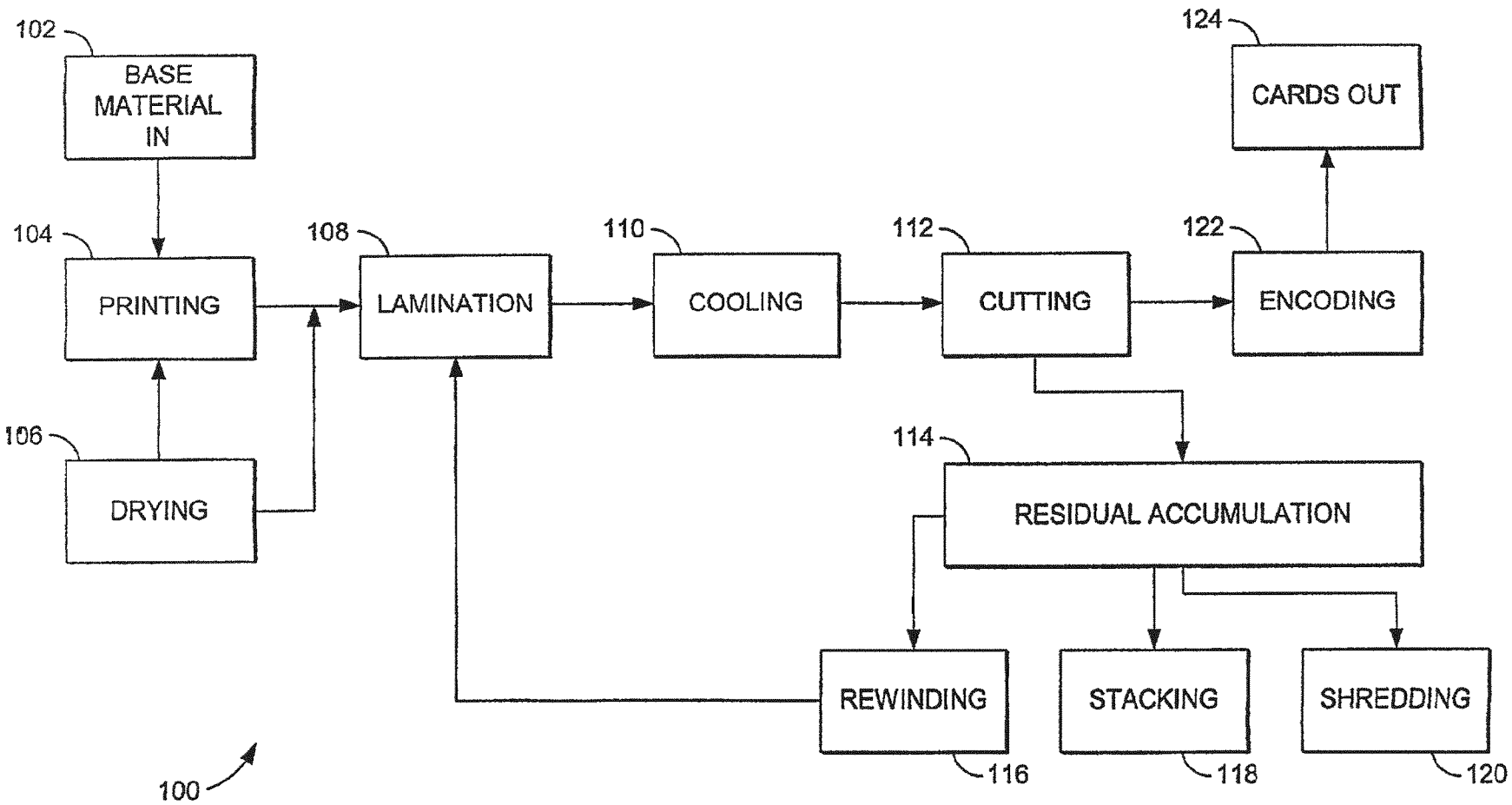
FIG. 4 is a flow diagram of the processes in an over-the-counter ID document assembling system in accordance with one embodiment of the invention.

FIG. 3 is an illustrative example of an ID document 10 manufactured in accordance with one embodiment of the invention, The ID document 10 includes substrate 21 (which for illustrative purposes only is illustrated as having a "card-like" shape) and the ID document 10 optionally can be sealed between first and second laminate layers 23, 25 (it should be understood that the ID document 10 also may be sealed with only one laminate layer (either the first layer 23 or the second layer 25), and also may be sealed with a plurality of laminate layers.

Although not required for the instant invention, the ID document 10 may include a photograph 14 and various printed information 12, e.g., such as data, textual information, graphics, bar codes, biometric information (e.g., fingerprint), personal information (e.g., name, address, etc.), or the like. At least a portion of the photograph and/or printed information is printed on the substrate 21 with ink jet ink printing 29. In at least one embodiment, both sides of substrate 21 can receive printing 29, such as ink jet color printing or ink jet black and white printing. In some embodiments, information may also be optically or magnetically stored on recording media (e.g., magnetic stripe 27) carried by one or both of the laminates 23, 25.

Heat and/or adhesive are used to bond the laminate sheets 23 and 25 with the substrate 21. The adhesive can even be coated or provided on a substrate-engaging side of the laminates 23 and 25. Or a laminate can include a pouch into which the substrate 21 slips. Again, heat and/or adhesives would be used to bond the substrate 21 with the pouch laminate. Hence, our preferred finished ID document includes at least a three-layer structure (e.g., laminate—substrate—laminate). The lamination provides a protective covering for the printed substrates and provides a level of protection against unauthorized tampering. (For example, a laminate would have to be removed to alter the printed information and then subsequently replaced after the alteration.). Various lamination processes are disclosed in assignee's U.S. Pat. Nos. 5,783,024, 6,007,660 and 6,159,327. Other lamination processes are disclosed, e.g., in U.S. Pat. Nos. 6,283,188 and 6,003,581. Each of these U.S. patents is herein incorporated by reference. Our present disclosure provides improvements over these lamination techniques.

Any or all of the printed information and/or images on the substrate may also include one or more built in security features, as well, to help reduce identity fraud. For example, in one embodiment of the invention, portions of the ID document 10, such as an image or a bar code, can include a digital watermark. Digital watermarking is a process for modifying physical or electronic media to embed a machine-readable code therein. The media may be modified such that the embedded code is imperceptible or nearly imperceptible to the user, yet may be detected through an automated detection process. The code may be embedded, e.g., in a photograph, text, graphic, image, substrate or laminate texture, and/or a background pattern or tint of the photo-identification document. The code can even be conveyed through ultraviolet or infrared inks and dyes.

Digital watermarking systems typically have two primary components: an encoder that embeds the digital watermark in a host media signal, and a decoder that detects and reads the embedded digital watermark from a signal suspected of containing a digital watermark. The encoder embeds a digital watermark by altering a host media signal. To illustrate, if the host media signal includes a photograph, the digital watermark can be embedded in the photograph, and the embedded photograph can be printed on a photo-identification document. The decoding component analyzes a suspect signal to detect whether a digital watermark is present. In applications where the digital watermark encodes information (e.g., a unique identifier), the decoding component extracts this information from the detected digital watermark.

Several particular digital watermarking techniques have been developed. The reader is presumed to be familiar with the literature in this field. Particular techniques for embedding and detecting imperceptible watermarks in media are detailed, e.g., in Digimarc's co-pending U.S. patent application Ser. No. 09/503,881 and U.S. Pat. No. 6,122,403. Techniques for embedding digital watermarks in identification documents are even further detailed, e.g., in Digimare's co-pending U.S. patent application Ser. Nos. 10/094,593, filed Mar. 6, 2002, and 10/170,223, filed Jun. 10, 2002, co-pending U.S. Provisional Patent Application No. 60/358,321, filed Feb. 19, 2002, and U.S. Pat. No. 5,841,886. Each of the above-mentioned U.S. Patent documents is herein incorporated by reference.

Embodiment 1

Process for Ink Jet Printing an Identification Document

Figure 6:
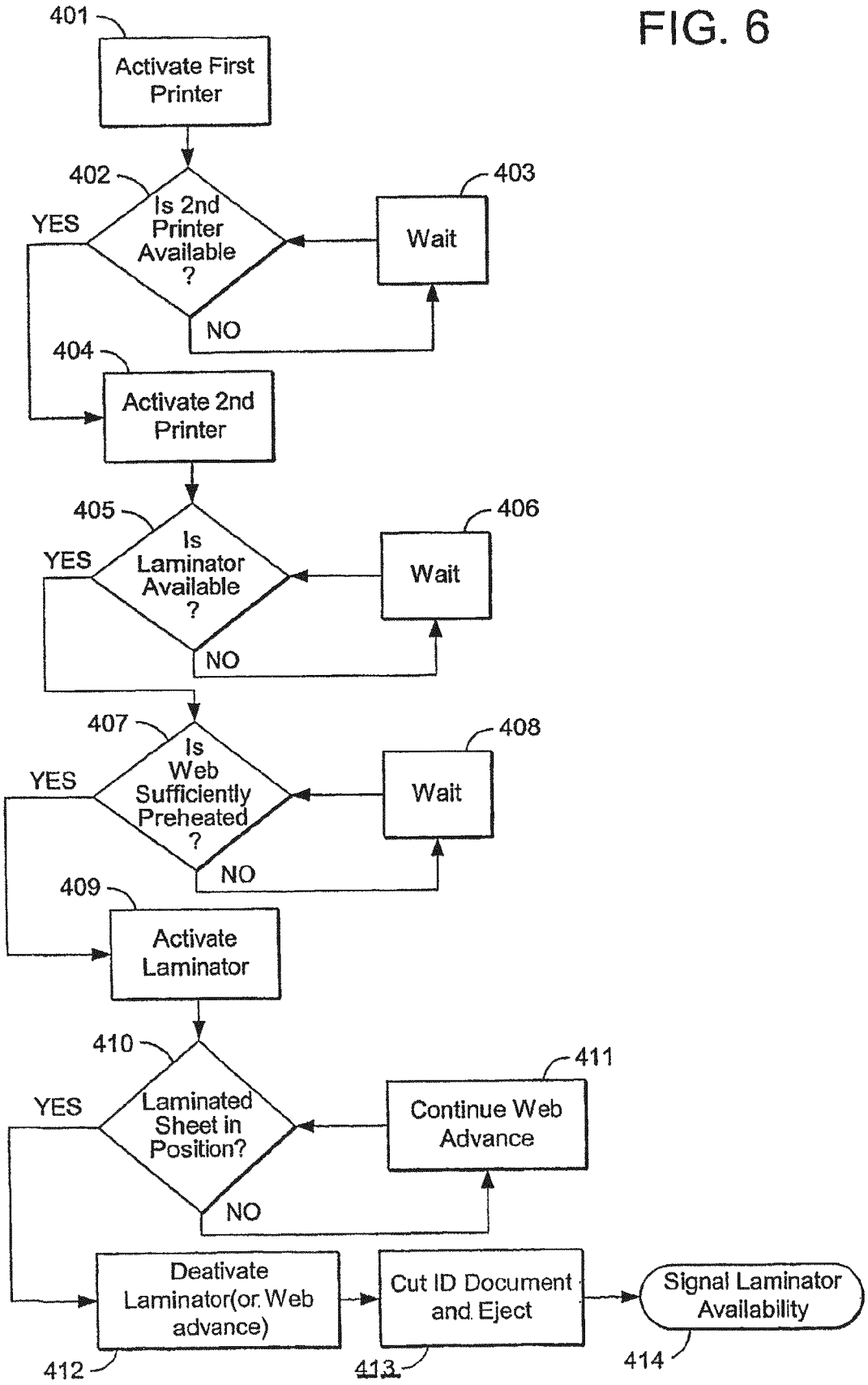
FIG. 6 is a flow diagram outlining one control process according to an implementation of the present invention.

FIG. 6 is a flow diagram of the general processes included in an over-the-counter ID document assembling system 100 in accordance with one embodiment of the invention. This general process is applicable to at least some of the other embodiments of the invention described herein and is provided to give the reader a general overview of the processes, systems, apparatuses, and techniques to be further described herein. Any or all of the following processes can be controlled manually, using hardware, using software, or using any combination of two or more of these.

Base material is provided for printing (steps 102, 104). The base material provided depends at least in part on the type of printer used. In one embodiment, the printing is accomplished using one or more inkjet-type printers and the base material is a material capable of being inkjet printed. In one embodiment, the printing is accomplished using one or more inkjet type printers that are supplied with a given pigmented ink jet ink and the base material is a material that has an affinity for the given pigmented ink jet ink. As those skilled in the art will appreciate, suitable ink jet printers are available from many different vendors, such as Hewlett Packard (3000 Hanover Street, Palo Alto, Calif. 94304), Epson (including, for example, the Epson Photo 2000P model) (3840 Kilroy Airport Way Long Beach, Calif. 90806), Canon U.S.A, Inc. (One Canon Plaza, Lake Success, N.Y. 11042) and Lexmark (740 West New Circle Road, 20 Lexington, Ky. 40550).

As an optional step, during and/or after printing of the base material, the base material can be dried (step 108), using, for example, an air dryer, heat lamp, or other drying device. Such forced drying advantageously can help to harden the ink printed onto the base material, speeding up the card manufacture and helping the printing to withstand rough handling (e.g., conveyors) between printing passes. Forced drying also can help to reduce bubbles and other problems that can occur during lamination, to help reduce such defects the final cards. If time permits, the drying of step 108 also can be accomplished by waiting or delaying the passage of the base material a predetermined amount of time necessary for the ink jet printing to dry. Those skilled in the art will appreciate that combinations of forced drying and time delays also can be used to accomplish drying.

Laminating step 106 can be accomplished using virtually any lamination system known in the art, including systems of heated rollers, pouches, patches of laminate applied directly to base material, platen lamination, carrier supported lamination, manual lamination, etc. Depending on the type of lamination used, during cooling (step 110) of the laminated base material, additional pressure can be applied to the laminated base material (such as a series of rollers and/or one or more plates) to help to keep the laminate flat during cooling.

Cutting of the laminated base material (step 112) can be accomplished in many different ways, depending on the type of base material and the configuration of the processes. For example, in at least some embodiments of the invention, base materials (as further described herein) are provided on carrier webs and are then laminated (including by methods such as patch lamination), such that the laminated base materials can be punched out, torn off, peeled away, or otherwise removed from the carrier web during cutting. For laminations accomplished using methods such as injection molding, cutting step 112 can encompass removing the injected molded base material from the mold. Depending on the particular lamination technique used, varying types and amounts of scrap material may result, For roll-type laminations, scrap material can be rewound (step 116) and later re-used). For platen and carrier supported laminations, scrap material can be accumulated as stacks or piles (step 118) and/or can be shredded (step 120). Shredding can be advantageous where the scrap may contain proprietary material (e.g., covert logs contained on the laminate material).

If the laminated base material has portions to be encoded (e.g., a magnetic stripe or bar code) (step 122), that can be done following cutting step (112). Of course, it will be appreciated that steps 112 and 122 can, of course, be reversed, especially in systems where orientation and registration of the base material can be controlled. After encoding, the laminated base material can be output as ID documents (step 124).

Embodiment 2

Dual Ink let Printing Process

This embodiment provides an inventive over-the-counter ("OTC") ID document printing system and related methods. As a general overview, and with reference to FIG. 5, our inventive OTC system 200 preferably includes two ink jet printers 202 and 204 (e.g., such as those manufactured by HP, Epson, Canon and Lexmark) a roll type laminator 205, cooler 214, pulling rollers 216, and a cutter/cardpunch 218. Although not illustrated in FIG. 5, those skilled in the art will appreciate that the system 200 of FIG. 5 can include mechanisms to power and drive the illustrated elements, such as a motor(s) and drive assembly to drive the rollers, etc. In at least one embodiment, the above components cooperate with a controller (not shown) to facilitate the smooth transition of a substrate through our inventive assembling system. The controller can be a software module executing on general-purpose processing circuitry. Or the controller can alternatively be implemented with hardware controls or hardware/software controls. The controller may even cooperate with various system sensors. Control also can be completely or partially manual.

A substrate sheet 219 (made of a material capable of being reliably printed with ink from the ink jet printer,) is provided to the first ink jet printer 202 with for printing. In at least one embodiment, the ink jet printers are supplied with a pigmented ink jet ink and the substrate sheet is a sheet of TESLIN, where the TESLIN does not require a receiver layer because the ink jet ink has been pre-selected to have an affinity for the TESLIN material. In at least one embodiment, however, the TESLIN can be pre-coated with a receiver layer and the ink jet ink need not be specialty pre-selected for the TESLIN.

Our ID document substrate is formed from the substrate sheet. The sheet is preferably somewhat larger than the size of a finished card. This over-sizing allows extra material to help, e.g., transport the sheet through system. This extra substrate material can be later trimmed to achieve a specified size. (Of course, the substrate sheet can be sized to a finished card as well.). The substrate sheet is placed in a sheet feeder 202*a* of the first ink jet printer 202. The first ink jet printer 202 prints desired printing (e.g., variable information, photographs, bar codes, graphics, etc.) to a first side of the substrate sheet.

The substrate sheet 219 is conveyed along a path 203 into a feed tray 204*a* of the second ink jet printer 204 preferably in a manner that presents a second side of the sheet to the second ink jet printer 204. (For example, path 203 is "C" shaped to present a second side of the sheet to the second ink jet printer's print head.). Path 203 can be achieved with a belt, roller system and/or vacuum, etc., as will be appreciated by those skilled in the art The second ink jet printer 204 applies desired printing to the second side of the sheet. The printed sheet is then conveyed from the second ink jet printer 204 to a laminator 205.

Laminator 205 preferably includes an upper laminate supply 212*a*, lower laminate supply 212*b*, guide rollers 210, preheating rollers 208*a* and 208*b*, and laminator rollers 206. (We note that in an alternative implementation, laminator 205 includes a subset of these components, such as only laminator rollers 206, or preheating rollers 208*a* and 208*b* and laminator rollers 206.). Although laminator 205 is shown as including the cooler 214, the cooler 214 need not be part of the laminator and can, in fact, be a separate item. Likewise, of course, any of the elements shown in FIG. 5 can be implemented individually and/or be provided as a combined element. For example, the printers 202, 204 could be combined as a single double sided printer, or can be combined with a laminator in a single housing, etc. The laminator 205 provides protective laminate layers for the substrate. In one embodiment, the laminator activates adhesive on the laminate web and then, using pressure between the laminator's nip rolls 206, press the laminates onto both sides of the printed substrate.

A common lamination material includes polycarbonate or polyester. Most frequently, such laminates include an adhesive layer or coating, such as EVA, EVA blends, etc. The laminator 205 receives laminate in the form of continuous webs from upper laminate supply 212*a* and lower laminate supply 212*b*. The laminate webs are fed from the supplies 212*a* and 212*b* via guide rolls 210*a* and 210*b*, respectively. The laminate webs are preheated with upper and lower preheating rollers 208*a* and 208*b*. An adhesive side of the laminate preferably faces (and contacts) the preheating rollers 208*a* and 208*b*. The preheating rollers 208*a* and 208*b* heat their respective laminates so as to bring the temperature of the laminate adhesive slightly below an activation temperature (around 170° F.) of the adhesive (e.g., between about 5-20° F. below the activation temperature). The preheating temperature is preferably such that the laminate material (e.g., amorphous polyester) does not soften to a point where it would unduly stretch from the preheating rollers 208*a* and 208*b* to the laminator roller 206. Laminator rolls 206*a* and 206*h* provide heat to activate the laminate adhesive, and press the upper and lower laminate onto respective upper and lower sides of the printed substrate sheet. In one implementation the laminator rollers 206 raise the laminate temperature from the activation temperature to about 230-240° F. In another implementation, we maintain our preheating rollers 208*a* and 208*b* between 150-180° F., and our laminator rollers 206 between 250-330° F. Since the speed of lamination is proportional to the lamination temperature (e.g., hotter is faster), in some implementations we raise the laminator rolls 206 above 330° F.

(It should be understood that, to simplify the discussion we have taken some liberty with the use of the term "roller" and "roll." Conventionally the term "roller" is used to specifically imply a metal or anodized metal surface, while the term "roll" is used to specifically imply a rubber coated roll that fits over or otherwise surrounds the metal roller. Such distinctions are not critical to the understanding of the present invention. Accordingly we use the terms roller and roll interchangeable herein.).

The laminated substrate sheet is provided to the cooler 214. In one embodiment, the cooler 214 includes a plurality of cooling rollers 215 to keep the laminates flat while cooling. In an alternative cooler 214 implementation (not shown) we provide flat heat sinks (instead of rollers) to contact the laminate surfaces. Those skilled in the art will appreciate that other ways of cooling the substrate sheet (e.g., immersion in a substance capable of cooling the laminate, directing cool air at the laminate, etc.) can be usable to cool the laminated substrate sheet.

The cooled, laminated substrate sheet is provided to the cutter/cardpunch 218. Cutter/cardpunch 218 is activated by the die set actuator 221. We note that a pair of pull rollers 216*a* and 216*b* can be provided and selectively activated to pull the continuous laminate web through the laminator 205 and cooler 214. Once the laminated substrate sheet is positioned within the cutter/cardpunch 218, the pull rollers 216*a* and 216*b* are deactivated, which stops the laminate web motion. The cutter/cardpunch 218 is cycled, cutting a card-shape ID document out of the laminated web. The resulting ID document is ejected from the cutter/cardpunch 218 onto, e.g., a conveyor to exit the card from system 200.

Since the printing and laminating/cutting processes are independent, it is possible to start printing another ID document while the laminating/cutting operations are processing a previous card. The laminating/cutting process duration is generally shorter than the printing process time; hence, the total cycle time after the first card can be reduced to the printing cycle time.

Figure 5:
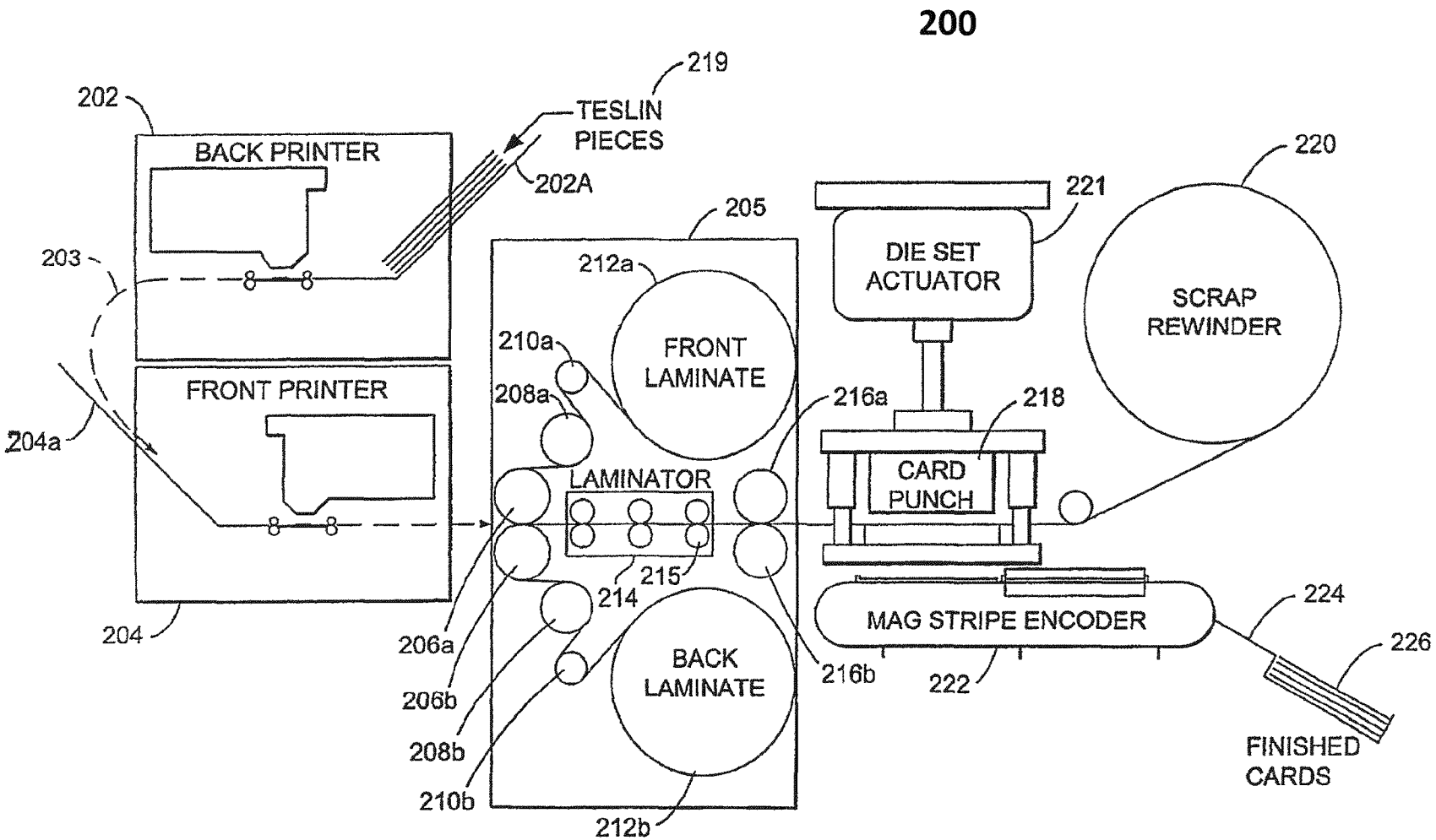
FIG. 5 is a diagram of an over-the-counter ID document assembling system including a first example of a dual ink jet printer implementation, in accordance with one embodiment of the invention.

In at least one embodiment, the system of FIG. 5 includes additional components such as a magnetic stripe encoder (writer) 222 for when the laminate (or substrate) includes a magnetic stripe suitable for carrying data. The magnetic stripe encoder 222 encodes (or writes) data within the magnetic strip. MagTek, Inc. in Carson, Calif. 90746 USA, provides suitable magnetic stripe technology, among other companies. The encoded data can be related to the printed information, or can include information such as biometric information, personal information, access permissions, privileges, etc.

In at least one embodiment, the system of FIG. 5 includes a residual material accumulator 220 to accumulate scrap or residual web laminate. For example, the residual material accumulator 220 can be a scrap rewinder, as shown in FIG. 5. The accumulator 220 may include or cooperate with a residual rewinder to rewind residual web laminate. A conveyer belt or other ejection mechanism 224 can be provided to eject the card from the system 200 to a finished card holder 226. Alternatively, accumulator 220 includes a shredder. An advantage of a shedder is that it reduces the size of residual materials, and destroys any residual security features that remain on the accumulated materials.

One or more dryers (not shown in FIG. 5) can be added to the system 200 to dry the printed substrate after and/or during printing. For example a dryer can be positioned along the 203 path and/or along a path 204*b* from the second printer 204 to the laminator 205. While a dryer may include radiant heating or the like, we prefer a forced hot air dryer. Forced drying has at least two advantages. First, forced drying produces "hardening" of the ink so that it can withstand rough handling between printing passes. Second, the drying of the sheet after final printing (e.g., after printing by the second printer 204) may also be useful in preventing moisture bubbles. Moisture bubbles occur during lamination and often produce visual defects in a finished card. In one embodiment, air drying for a predetermined time (such as by delaying the substrate along the path 203 and/or the path between the front printer 204 and the laminator 205) can be used in place of forced drying.

With reference to FIG. 6 we provide an overview of one implementation of a system controller. The FIG. 6 implementation is ideally suited for a multi-card printing process. We also note that the illustrated control process need not continue to completion before a second iteration of the control process of initiated. The first printer is activated in step 401. The printer can be activated by an activation signal from the controller, or upon an indication that a substrate sheet is positioned within the feed tray. We note that the activation step may include receiving in the first printer print data to be printed on the substrate sheet. After (or during) printing of the first side of the sheet, it is determined whether the second printer is available (step 402). (We note that this step can be eliminated when printing a single card.). If not available, the process waits (403) until the second printer becomes available. The second printer may not be available for a number of reasons, including waiting on the laminator or die cutter, printing another sheet, etc.

The second printer is activated (404) when it becomes available. After (or during) printing of the second side of the sheet, the controller determines whether the laminator is available. The laminator may not be available for a number of reasons, including the processing of a preceding card, waiting for the lamination web to be heated, waiting for cooling, etc. As an optional step, it can be determined whether the web is sufficiently heated (steps 407 and 408).

If available, the laminator is activated (409). Activating the laminator may include a number of steps, such as pulling the laminate web, e.g., with the pull rollers, heating rollers if needed, accounting for cooling time if needed, etc. The laminate web is pulled until it is determined whether the laminated sheet is positioned in the cutter (step 410 and 411), at which point the laminator is deactivated (412). The laminated sheet is cut into an ID card and is ejected from the system (413). After cutting (or after ejection) the controller can generate a signal (414) to indicate that the laminator is available. The signal can be used, e.g., as input at step 405.

We note that there are many variations of the FIG. 6 control process. For example, the process can be segmented into various control sections, such as a printing section and a lamination/cutting section. The control of each section can be separately handled. Or if precise timing of the printing and lamination sections is determined, the control process can be simplified. In the simplified implementation, the control process may start printing and then simply check whether the laminator is available prior to advancing a printed sheet to the laminator. In still other implementations, the controller relies on signals from the printers, laminator, cooler, sensors and/or cutter to regulate the advancement of a substrate (or substrates) through the system. Of course, other control process can be implemented to control the FIG. 2 system 200.

Embodiment 3

Dual Ink jet Printing Process with Alternate Printer Configurations

While the FIG. 5 embodiment (and various alternative embodiments related to FIG. 5) describe a first ink jet printer positioned directly over, and positioned in an opposite direction of, a second ink jet printer, the present invention is not so limited.

For example, the printers 202 and 204 can he arranged one above the other, but both facing in the same direction and positioned on opposite sides of a substrate sheet such that the first printer prints one side of the sheet, and the sheet travels in a straight path into the second printer where the other side of the sheet is printed. Since the second printer is positioned "upside down," the ink droplets travel horizontally (or vertically, depending on printer positioning) to the sheet without the normal assistance of gravity. Our experiments reveal satisfactory printing under such upside down printing conditions.

Figure 7:
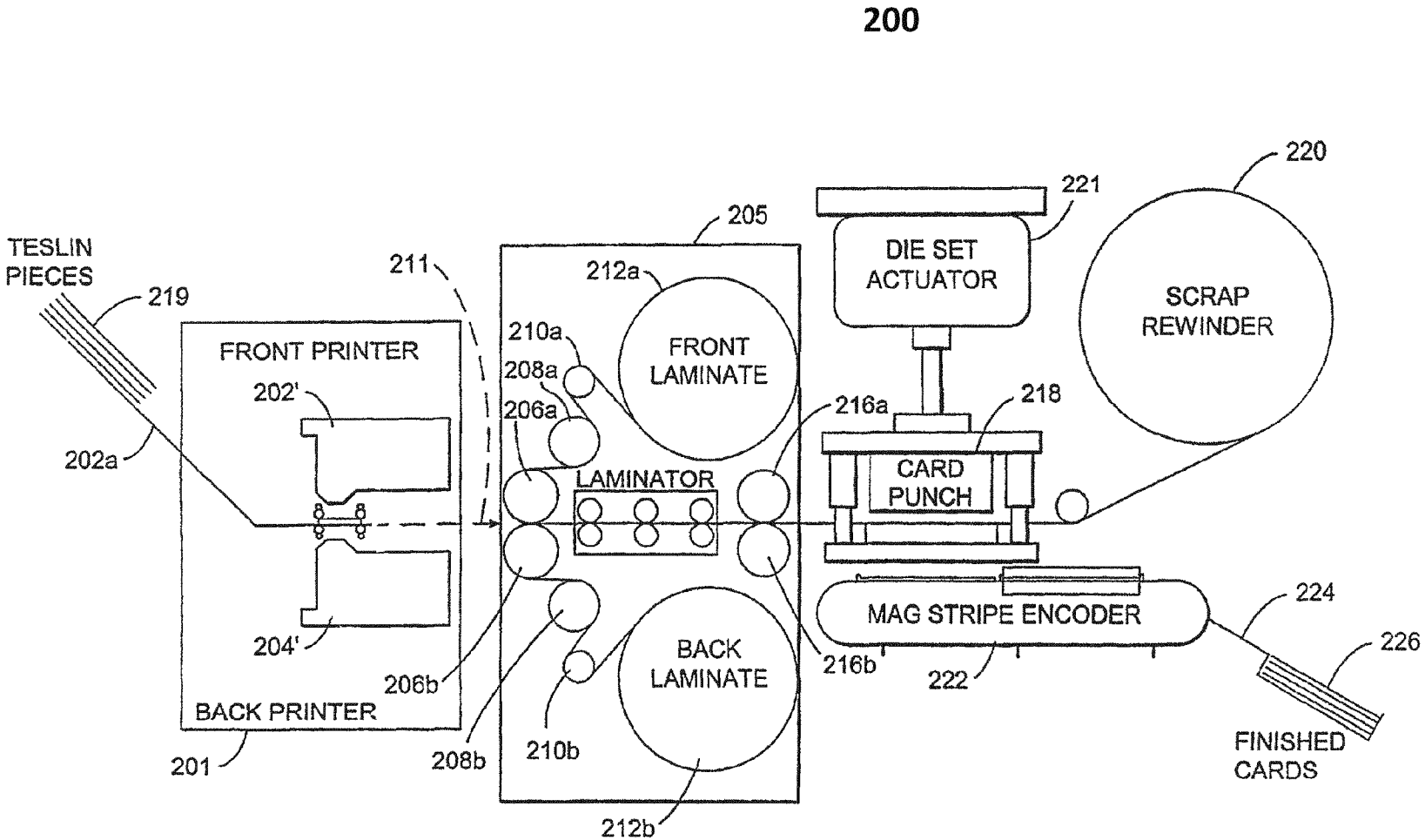
FIG. 7 is a diagram of an over-the-counter ID document assembling system including a second example of a dual ink jet printer implementation, in accordance with one embodiment of the invention.

Another implementation, shown in FIG. 7, prints both substrate sides at substantially the same time. Referring to FIG. 7, an inkjet printer 201 is configured with two print heads 202', 204', each to respectively perform printing on a respective side of a substrate. A substrate is printed as it travels between the two print heads. Since the print cycle time is a major time factor in an ID document manufacture, and since a dual print head configuration significantly reduces the overall size of the processing unit, a simultaneous or substantially simultaneous printing configuration is an attractive embodiment. Although not shown in FIG. 7, a one or more dryers could be positioned along path 211 to dry one or more sides of the substrate. The dryer or dryers can, of course, be configured to dry both sides of the substrate at the same time.

Embodiment 4

Dual Ink Jet Printing Process with Alternate Laminator

In this embodiment, platen lamination is used in alternative embodiments instead of a roll laminator 205 describe in the previous systems. A platen lamination process basically involves placing a platen (e.g., metal, glass or ceramic surface) in contact with a laminate to impart heat and/or pressure, so as to activate the laminate adhesives. Some laminates (e.g., amorphous polyester laminates) soften during a lamination process, and as a result the laminate may take on a finish of the laminating or cooling surfaces (e.g., rollers or platen).

So-called gloss finish platens can be provided to provide a smooth or glossy laminate finish. Alternatively, a belt with release properties that allows release from a cooled belt can be used as an interleaf between the card and platen. In order to prevent air entrapment between the gloss finish platen (or gloss finish belt) and the laminate, a matte finish can be provided on the outer surfaces of the laminates.

Platen lamination is not understood to have been heretofore used for over-the-counter (OTC) ID card lamination because of the large-sized hardware and complexity in comparison to a roll type laminator; however, we have found that platen lamination offers some unique capabilities that offset these drawbacks. For example, materials that have poor dimensional stability at lamination temperatures can often be processed only in platen presses where both heating and cooling occurs while the materials are under pressure and constrained from unwanted dimensional or physical changes. The heating and cooling steps can be carried out in one or more stations. When carried out in only one station, the hardware size is smaller, but the platens must cycle between the heating temperature and the cooling temperature, which can result in longer cycle times. When carried out in two stations, the hardware size increases but the cycle time decreases because the platens in each station are maintained at the proper processing temperature. A platen embodiment is later below.

Embodiment 5

Single Ink Jet Printing Process

Figure 8:
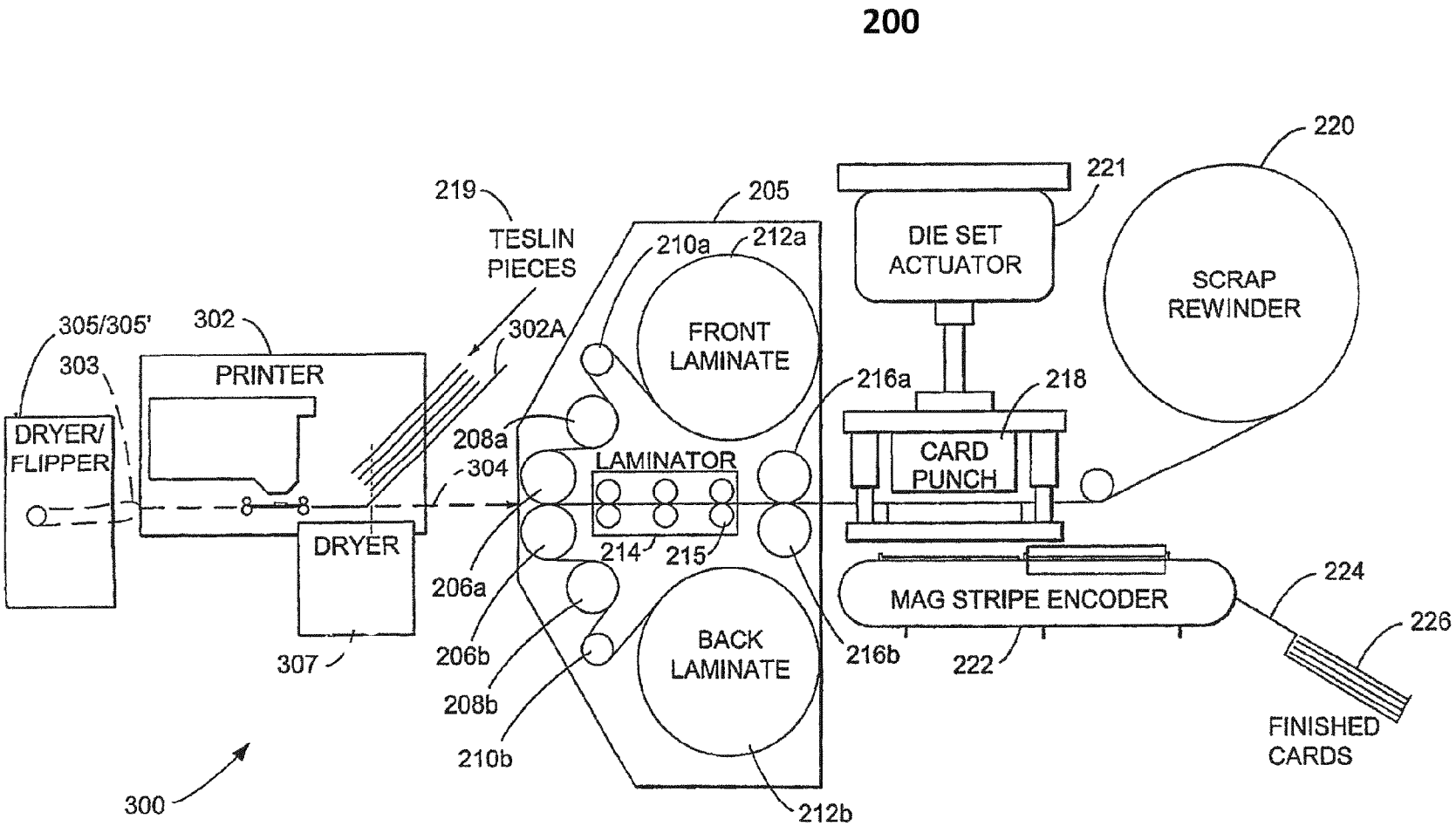
FIG. 8 is a diagram of an over-the-counter ID document assembling system including a single ink jet printer implementation; in accordance with one embodiment of the invention

The FIG. 5 embodiment can be modified to include a single printer system 300, instead of the dual printer system 200, as shown in FIG. 8. A single ink jet printer 302 is used to print both sides of an ID document substrate. A substrate sheet 219 (e.g., a TESLIN sheet) is placed in print tray 302*a*. Printer 302 prints a first side of the sheet. A first sheet conveyor 303 (e.g., a conveyor belt, guide rollers, vacuum, or etc.) is provided to return the printed sheet 219 to the print tray 302*a*. The first sheet conveyor 303 preferably returns the printed sheet 219 to the print tray 302 in an orientation that allows printing of a second side of the substrate sheet by printer 302. Optionally, the system 300 can include a dryer 305 to dry the first printed side of the substrate 219 along the path 303. Optionally, the system 300 can include a dryer 305' to dry the other printed substrate along the path 304. Optionally, a dryer 305' can he configured to dry both sides of the substrate simultaneously along the path 304 (not shown in FIG. 8). Optionally, the system 300 can include a "flipper" 305', which can assist the first sheet conveyor 303 in returning the printed sheet 219 in an orientation that allows printing of a second side of the substrate by printer 202 by automatically turning the substrate 219 over. Such "flipping" can, of course, also be accommodated manually.

Referring again to FIG. 8, a second sheet conveyor 304 then conveys the laminated sheet to laminator 205. We note that like components including the same functionally are labeled with the same reference numbers in FIGS. 2 and 3.

Of course a controller (not shown) can be used with system 300 to control the printing and conveyance of the substrate sheet and of the lamination and cutting of the printed sheet.

The dryer 305 (not shown) can be added to the system 300 to dry the printed substrate after printing. For example a dryer can be positioned along the 303 and/or 304 paths. Dryer advantages are discussed above with respect to FIG. 5.

One advantage of system 300 over system 200 is that one printer 302 accomplishes the work of two printers 202 and 204—saving hardware cost and size. We note that system 300 does not experience a significant increase in printing time over system 200 since system 200 sequentially prints the front and back of a substrate sheet.

Embodiment 6

Ink Jet Printing with Carrier Supported Laminates

We note that a substrate sheet is typically much shorter than the assembling path that the laminate web travels (e.g., referring to FIG. 5, starting at the guide rollers 210*a* and 210*b*, past the preheating rollers 208*a* and 208*b*, through the pressure (or "nip") rolls 206*a* and 206*b*, cooler 214, through the pull rollers 216*a* and 216*b* to the cutter/cardpunch 218). Thus the amount of laminate that is consumed in processing one substrate sheet is often 4 or 5 times the amount of substrate used, resulting in a laminate design yield of no more than 20% to 25%. We can improve the yield with our following inventive techniques.

Any or all of the systems of FIGS. 4-8 are modified to reduce the amount of laminate required to manufacture an ID document by using patches or discrete card-sized sheets of laminate. The laminate patches are bonded to or otherwise carried by a carrier web. We space the laminate patches along the carrier web such that the carrier web—and not laminate—spans the majority of the assembling path. This configuration significantly raises the laminate yield, while reducing overall costs.

Figure 9:
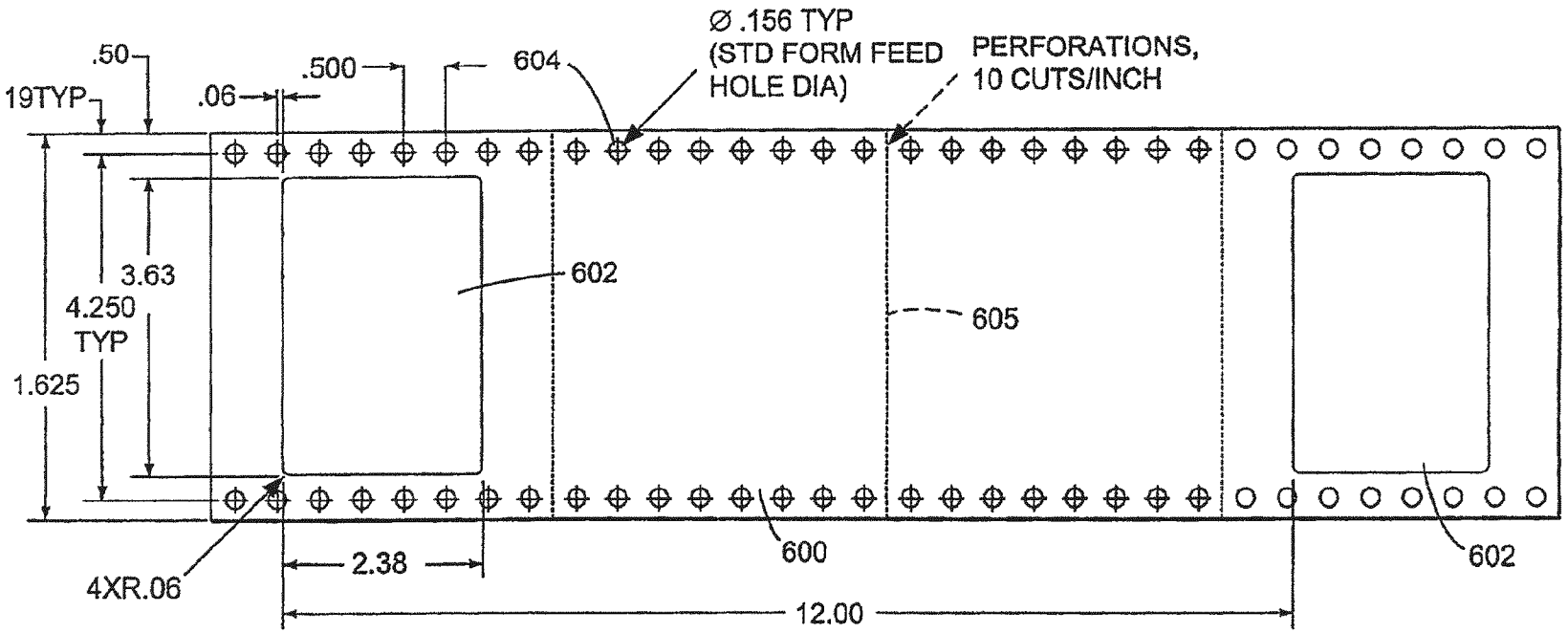
FIG. 9 is an illustration of a carrier web usable with at least one embodiment of the invention.
Figure 10:
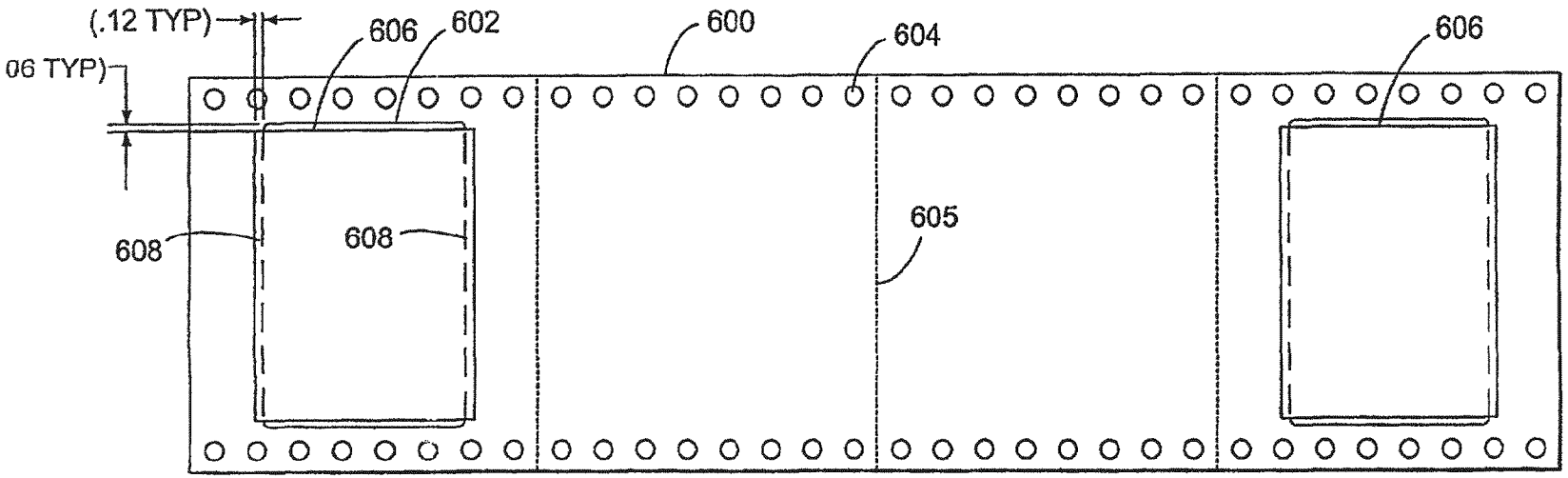
FIG. 10 is an illustration showing laminate patches on the carrier web of FIG. 9.

FIG. 9 is an illustration of a carrier web 600 usable with at least one embodiment of the invention, and FIG. 10 FIG. 10 is an illustration showing laminate patches on the carrier web 600 of FIG. 9 (it should be understood that in FIGS. 9 and 10, the dimensions shown are not limiting and provided by way of illustration only). Referring to FIGS. 9 and 10, the carrier 600 preferably has "windows" 602 throughout the web (e.g., with no carrier material in the windows). In one embodiment, the carrier 600 is made from 2 mil liner paper. In this example, the carrier web 600 is constructed for use in form feeding (as described further herein) and includes a plurality of form feed holes 604, but the invention does not, of course, require that the carrier web 600 be used in a form feeding type environment. The laminate patches 606 are bonded to the carrier web 600 at (or over) these carrier windows 602. In one embodiment, one or more heat seals 608 bond the laminate patches 606 to the carrier web 600. The windows 602 help prevent carrier material from being introduced into a final ID card. Referring again to FIG. 5, the laminate patches 606 (and carrier windows 602) can be spaced so as to enter the laminator 205 (e.g., enter the preheating rollers 208*a* and 208*b* or laminator rollers 206*a* and 206*b*) when a previous laminate patch is in the cutter/cardpunch 218.

(In one implementation, by way of example, the laminate patch is about V4 inch larger in all four directions than the substrate sheet. This over-sizing allows a buffer for, e.g., sufficient laminate overlap, extra material to be handled by the rollers, cutting imprecision, and even a so-called "dead zone," if desired, to buffer the lamination roller 206 from riding up over the laminate on the carrier web.).

Figure 2:
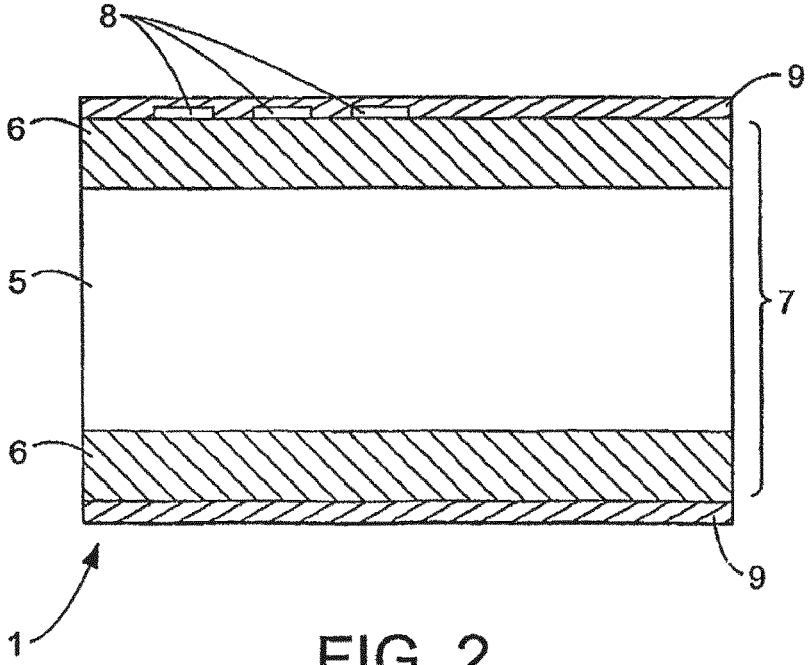
FIG. 2 is a cross section of the prior art identification document of FIG. 1, taken along the A-A line.

We note that the carrier web 600 including the bonded or carried laminate patches 606 over the carrier web windows, can be introduced to the laminator 205 in roll form (e.g., replacing the laminate web supply 212*a* and 212*b* shown in FIGS. 2 and 3). As an alternative, the carrier web is feed through a guide roller (e.g., rollers 210*a* and 210*b*) from a box or other source of fan-folded laminate patches on carrier web. In this alternative implementation, the source of fan-folded laminate patches 606 on carrier web 600 replaces the upper and lower laminate supply 212*a* and 212*b*.

Figure 11B:
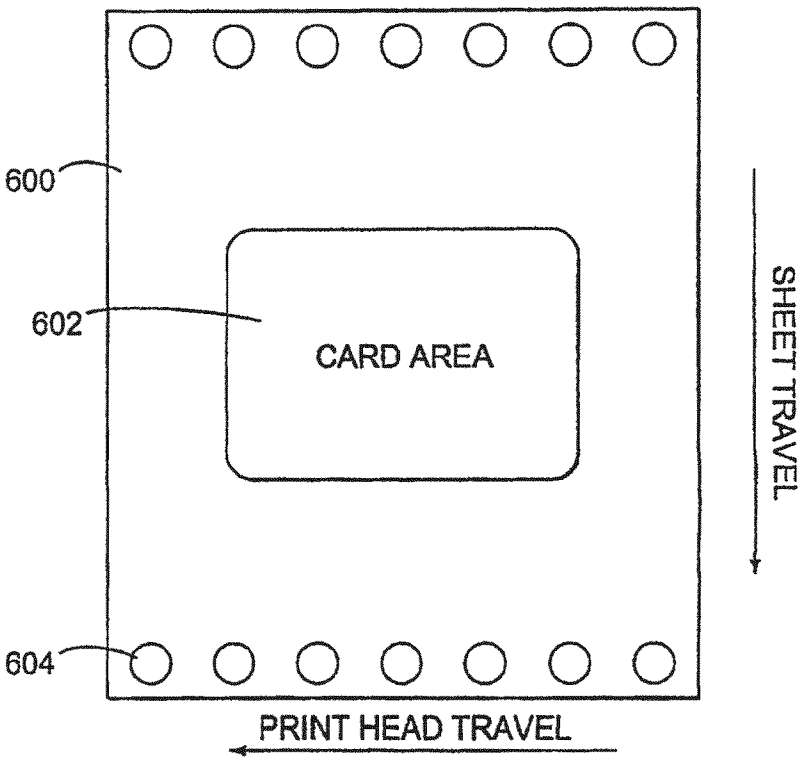
FIGS. 11A-11B are illustrative examples of sheet and print directions for first and second travel orientations, in accordance with embodiments of the invention.
Figure 11A:
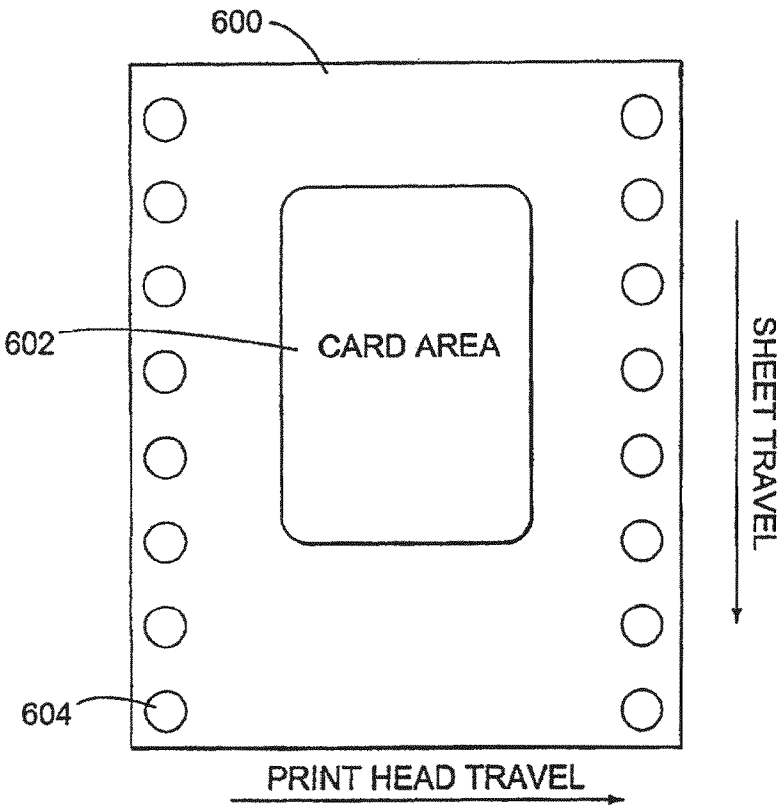

The orientation of the card and laminate patches 606 is not limited to that illustrated in FIGS. 9 an 10. FIGS. 11A-11B are illustrative examples of sheet and print directions for first and second travel orientations, in accordance with embodiments of the invention. For the example of ID documents having a substantially rectangular shape, the windows 602 can be oriented on the carrier web 600 such that the long axis of the ID document travels in the machine direction (long orientation, FIG. 11 A) or such that the short axis of the card travels in the machine direction (short orientation, FIG. 11B).

In the long orientation, the sheet moves through the printer so that the axis of the long dimension of the ID document runs parallel to the direction of travel of the sheet. The printhead therefore traverses the short dimension of the ID document making many short traverses to print the ID document. In the short orientation, the axis of the short dimension of the ID document runs parallel to the direction of travel of the sheet. The printhead therefore traverses the long dimension of the card and is required to make fewer but longer distance traverses in printing the card.

During experimentation with an Epson Photo 2000P printer, we found that the time required to print the front of a sheet was 69 seconds with the long orientation sheet where the print head makes many short traverses and 45 seconds with the short orientation sheet where the print head makes fewer but longer traverses. When set at the high quality print setting, the long orientation sheet required 134 seconds to print the front of the card, and the short orientation required 93 seconds.

Several other advantages result from our carrier web improvements, in addition to improving laminate yield.

First, between card cycles, in the processes illustrated by FIGS. 4-8, the thermoplastic laminate is in contact with heated rollers (e.g., preheating rollers 208*a* and 208*b* and/or laminator rollers 206). Such heated roller contact may require that the roller temperature be reduced between cycles and then reset when a next assembling cycle begins. With a carrier web laminate system, however, the carrier is in contact with the laminator rolls between card cycles instead of the laminate material. The carrier web can be tailored to withstand various temperatures. For example, paper-based carrier webs are relatively inexpensive and more temperature resistant than the laminates at laminating temperatures.

Second, a paper-based carrier web is dimensionally stable at the laminating temperatures and pressures. Hence the carrier web provides support for the thermoplastic laminate, which looses dimensional stability (e.g., the laminate softens and stretches) during the lamination process.

Figure 12:
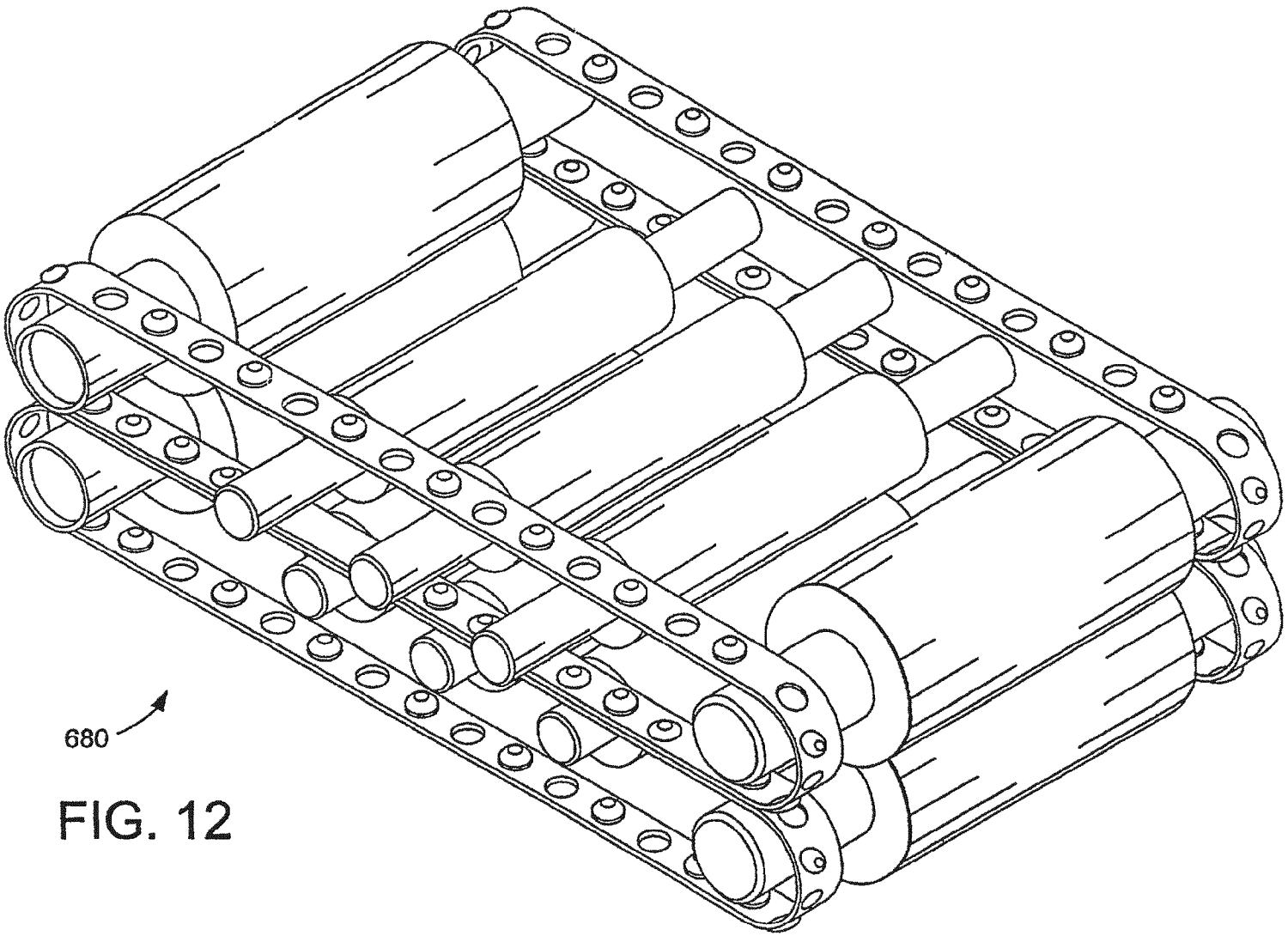
FIG. 12 is a perspective illustration of a laminator roll assembly usable with at least one embodiment of the invention.

Third, a dimensionally stable carrier web can be provided with form feed holes (or perforated holes or notches) punched or otherwise provided in the edges of the carrier web. For example, FIG. 12 is a perspective illustration of a laminator roll assembly 680 (including, e.g., rolls 206*a*, 206*b*, 215 (all rolls), 216*a*, and 216*b*) adapted to be used with carriers having form feed holes. Those skilled in the art will appreciate that the laminator roll assembly 680 is merely illustrative and that many different ways of using form feed holes with rollers are, of course, usable. The carrier web then not only provides laminate transportation, e.g., by moving the carrier web through the lamination and cutting processes using pin or notch engagements, but the carrier web can also be used to accurately register laminates with respect to each other and to a substrate sheet.

Providing form feed holes in the substrate sheet further enhances this registration process. The form feed holes provide enhanced registration of the substrate with the top and bottom laminate patches (in comparison to edge guiding or optical registration methods). The form feed holes also enhance registration of security features provided to the laminate surface, if desired, along with improving registration for the cutter/cardpunch 218. We can print information closer to a substrate edge as our cutting registration improves.

Figure 13:
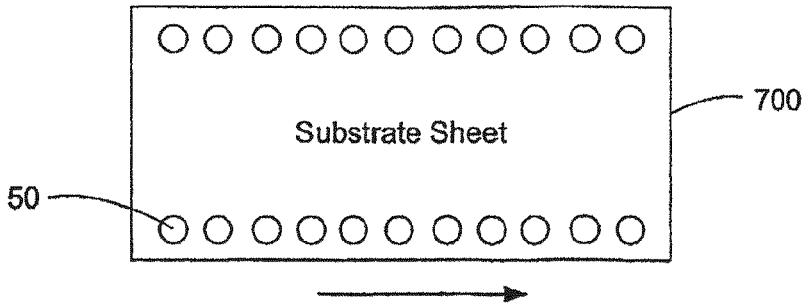
FIG. 13 is a diagram of a substrate sheet including a plurality of form feed holes along its direction edges.

Now consider a process set in any of the FIG. 4-8 system environments, with the following modifications, which leverages the above third advantage. The process receives a substrate sheet. With reference to FIG. 13, form feed holes (or other notches or openings) 50 are pre-punched along directional edges of the substrate sheet 700. For example, the arrow in FIG. 13 shows a directional edge of the sheet 700, e.g., the direction the sheet 700 typically travels in an assembling system. The form feed holes 50 are placed outside an area in which the card will be cut or where information will be printed. The substrate sheet 700 is preferably over-sized to allow room for placement of the form feed holes. The substrate can be later trimmed to a specified size.

(In an alternative implementation, not shown, we only include form feed holes along one of the directional edges.).

In one implementation, we start with about a ½ inch additional material on the two directional edges that receive the form feed holes, and about ⅛ inch on the two edges that run perpendicular to the directional edges. This particular sizing produces about a 69% material utilization. Of course these over-sizing dimensions can be changed to system needs and/or material utilization requirements.

Referring to FIGS. 5 and 7, e.g., after printing by the first 202 and second 204 printers (or, referring to FIG. 8, after the printer 302 prints both sides of the substrate), the perforated, printed substrate is conveyed into laminator 205. Such conveyance can be accomplished using the form feed holes, if desired (see e.g., FIG. 12). For example a pin belt or wheel including a plurality of pins is provided, as will be readily understood by those skilled in the art. The pins engage the form feed holes, and cycling the belt or wheel conveys the substrate through engagement of the pins with the holes. The arrival of the substrate sheet at the laminator 205 is preferably timed to coincide with an arrival of the laminate on the carrier web. For example a sensor can sense a position of a printed substrate sheet (e.g., senses a leading for trailing edge of the sheet) as it is conveyed from the printer. It can also be determined when a timing marker (or position or counter) reaches a predetermined position, indicating a pin engaged in the leading hole of the sheet is at the same distance from a merge point as the laminate patches. A substrate conveyer (or pin belt) motor can be slaved to the laminator motor causing the ID card's three components (laminate—substrate—laminate) to arrive at the laminator 5 in registration. The form feed holes in the printed sheet are engaged by the pins conveying the supported laminate around the laminator rolls. In an alternative implementation, sensors (or timing modules) sense or otherwise determine the position of the laminate and/or substrate, and the controller controls the relative conveyance (or arrival) of the substrate and/or laminates to the laminator 205.

In one implementation, we register the placement of the substrate sheet and laminate patch by aligning form feed holes on the substrate sheet with form feed holes on the carrier web. Pins engaging the aligned form feed holes can be used to transport the supported substrate and laminates into and through the laminator 205. The laminator 205 activates the laminate adhesive, and then using pressure between the rollers 206 presses the laminates onto both sides of the printed substrate sheet. A cooler 214 keeps the laminate flat while cooling. The cooled laminate then enters the cutter/cardpunch 218. The laminator 205 and carrier web motion are deactivated once the laminated substrate is properly positioned within the cutter/cardpunch 218. The positioning of the laminate substrate in the cutter/cardpunch 218 is enhanced through alignment of the form feed holes or through transporting the laminated substrate via engagement of the holes.

We note that residual carrier web and laminate can be accumulated with an accumulator (including a shedder). Cutting, encoding, scrap accumulation and shredding, and ejection otherwise proceed as discussed above with respect to FIGS. 4-8.

We note that the pull rollers 206*a* and 206*b* can be replaced with a pin or notch-based conveyance system in this third embodiment. A pin or notch system can also be optionally used in the printer paths 203 and 204*b*.

As an alternative implementation, the substrate is provided as a roll (e.g., web), instead of sheets. The system then includes a sheet cutter to cut a substrate at some point 20 prior to the printing process.

Similar modifications can be made to the embodiments of FIGS. 4-8. For example, a pin or notch-based conveyance method can be used to transport a printed substrate along paths 303 and 304 and/or transporting the substrate, laminate piece and carrier webs through the laminator 205, cooler 214 and into the cutter/cardpunch 218.

Embodiment 7

Additional Alternative Implementation

While using a carrier web is an attractive solution to improve lamination yield, excess carrier web waste may be an unintended byproduct. We have developed an implementation to significantly reduce subsequent carrier web waste. Instead of using a carrier web as a "continuous" web that is controlled by maintaining down web tension (e.g., by puller roller 216) a discrete piece or sheet of carrier can be used for each individual laminate piece. Similar to the embodiments shown in FIGS. 9 and 10, a single piece of laminate is "picture framed" on and then bonded to (or otherwise carried by) each carrier sheet. These individual carrier sheets can be provided from a roll or fan folded box of continuous carrier with laminate patches. The carrier pieces are then cut into the single pieces prior to entering the laminator 205, or are separated from the roll by fracturing the carrier along a cross web perforation line 605 (FIG. 9). Or a carrier sheet can be obtained from a stack of carrier sheets. As with the carrier web above, the carrier sheet includes and opening or window 602 over which the laminate piece 606 is placed or bound). Form feed holes 604 along the edge(s) of a carrier sheet are used to convey the individual carrier sheet through the laminator 205, cooler 214 and cutter 218. Pin feed mechanisms control the carrier sheet/laminate motion and alignment by transferring forces through engagement of the carrier web form feed holes.

Consider the following modifications to the embodiments of FIGS. 4-8. Form feed holes are pre-punched along directional edges of a substrate sheet, and along at least the carrier sheet. Once the substrate is printed, the printed sheet is conveyed into the laminator 205, using the form feed holes, in registration (e.g., alignment) with the laminate patches on the carrier sheet that has been started into the laminator 205. Once laminated and cooled, the laminated substrate is transported to and positioned in the cutter by using a pin belt with pins engaging the form feed holes.

Die Cutter Configurations

Blanking dies are ideally suited to serve as cutter/cardpunch 218 (see FIGS. 2*b* and 3*b*). This is because of the precision with which resulting card dimensions can be maintained, an important issue in meeting, for example, ISO specifications, particularly for card height which has a tolerance of only +/−0.002". Accordingly, we can favorably use a blanking die cutter as cutter/cardpunch 218. The present invention, however, should not be construed as being limited to such.

For example, a rotary die cutter can alternatively be used. A rotary die cutter produces similar dimensional precision, in comparison to a blanking die, as well as providing a continuous motion process that might offer some design advantages when coupled with other continuous motion processes. Of course, the complexity of a rotary die cutter and the high forces required to cut the two cross web sides of a card are two of the major issues to be considered when using a rotary die cutter.

Steel rule die cutting is also another alternative cutter. The big advantage of this die cutting method is the relatively low cost of the tooling. An issue that needs to be considered when using a steel rule die cutter is the high force that is required to cut the entire perimeter of the card at one time. The hardware capable of generating that type of force is typically either physically large, or noisy in that a large amount of previously stored energy is released from a flywheel or other type of energy storage device when the card is cut. The other issue is manufacturing dies with a dimensional accuracy required, e.g., by ISO card height tolerance specification.

Laser cutting can also be used. Some factors to consider when using a laser cutter are avoiding card edge char, addressing roughness of a cut card edge, the personal safety requirements needed for such devices, and the environmental handling requirement of the laser off-gases.

Die Cutter Press Configurations

Several alternative methods can be used to generate a force required to blank die cut a card in the processes described above. Since a blanking die can be fashioned with a shear angle or double shear angle on the face of a punch without sacrificing dimensional accuracy of the card product, only a small portion of the total card perimeter is cut at a given instant in a cutting cycle. This greatly reduces the force required to cut the card. Therefore a small electric motor driving a high mechanical advantage screw or other drive mechanism would be sufficient to slowly cut the cards. Faster cycle times would be possible with an energy storage system like a spring or flywheel device that becomes "charged" during the relatively long off-duty cycle time and is discharged during the brief cutting cycle.

Hydraulic or compressed air presses can be used for many of the cutting methods described above.

An inventive improvement to powering conventional blanking dies is to use a bank of low profile electrical solenoids to provide a driving force to drive a blanking die. At least two major advantages derive from this solenoid method: high speed of operation and a small volume required for the hardware.

Card and Card Component Conveying

While a number of conveying mechanisms have been discussed above, we note that belts may offer advantages in conveying thin flexible materials (e.g., laminate and substrate sheets) used in our card constructions. Belt drives are simple, reliable and can be tailored to provide a level of belt friction required for positive feeding or controlled slip. For example, belts can be used as printer paths 203, 204*b*, 303 and 304. And belts can be used along the laminator path, cooler path and ejection path.

Yet we believe pin belts that positively engage a form feed hole or feature cut into a card component is perhaps the best method to accurately register parts to one another, and transport material through our inventive systems.

Roller feeds have many of the same characteristics as belt conveyors, and can be alternatively employed in our system.

A vacuum-based conveyance is also an alternative method for conveying.

Embodiment 8

Rotary Table or Linear Carriage Using Platen Lamination

Platen lamination is ideally suited for a rotary table or a linear carriage. Rotary tables and linear carriages comprise dedicated stations that are respectively devoted to a specific processing step, and ID document parts (e.g., front laminate, substrate sheet, and back laminate) are fed into or unloaded from each station.

Figure 14:
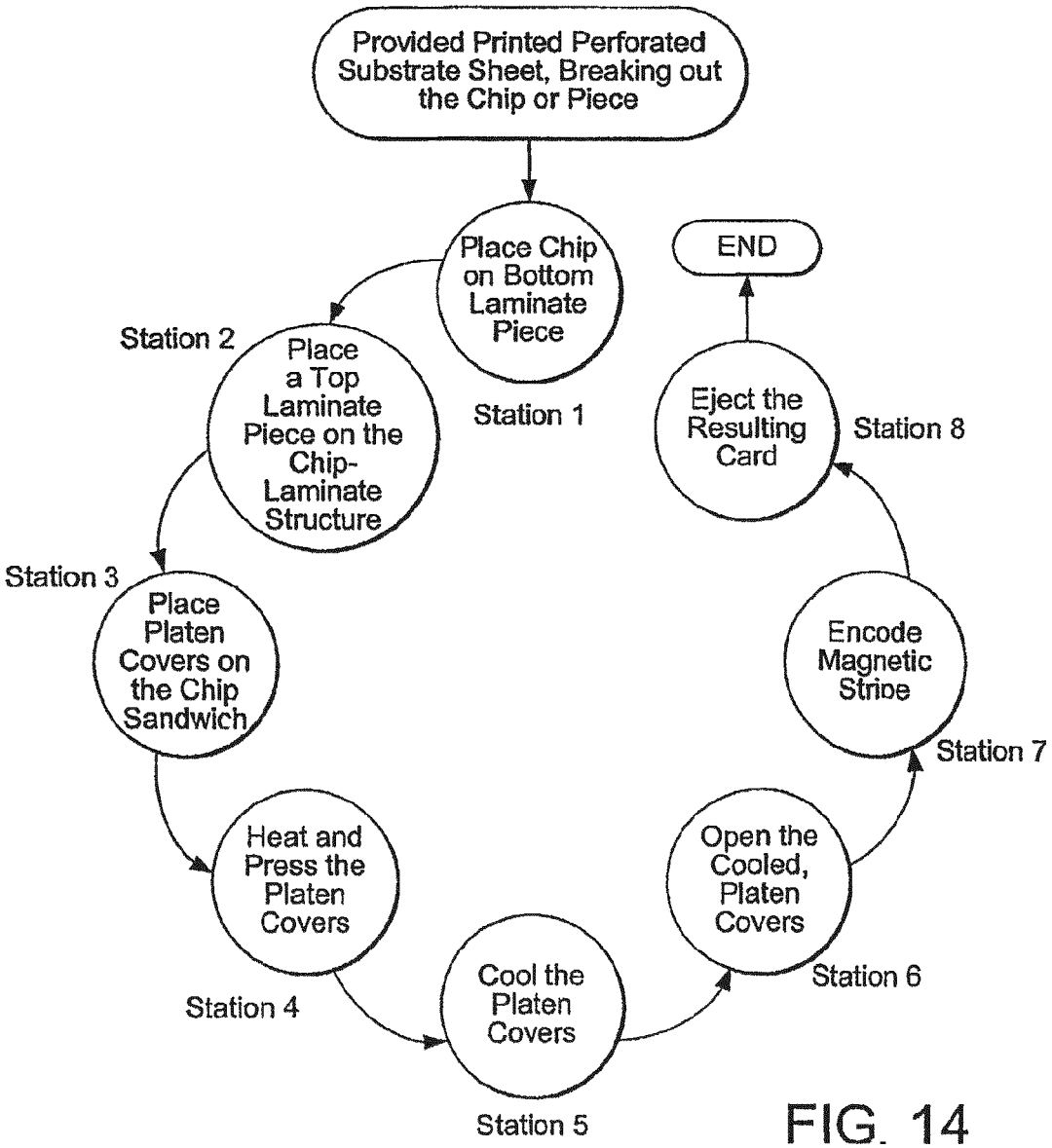
FIG. 14 is a diagram of a rotary table processing method according to an implementation of the present invention.

Consider our inventive rotary table ID card assembling process with reference to FIG. 14. Our process starts with small sheets of substrate that are somewhat larger than the size of a finished ID document. The sheets are preferably precut or perforated such that a final card-sized chip is contained within the overall small substrate sheet. The substrate sheet is placed in a sheet feeder of a first ink jet printer. The first ink jet printer applies desired printing to one side of the substrate sheet. The substrate sheet is conveyed into the feed tray of the second ink jet printer in a manner that presents the reverse side of the sheet to the printer. The second ink jet printer applies desired printing to the reverse side of the sheet. (Alternatively, the second printing cycle is performed by the first printer as discussed, e.g., with respect to FIG. 5.). The printed substrate sheet is provided to a first station.

(The printed substrate is preferably conveyed to the first station around a sharp or otherwise pronounced bend in order to break the precut, final-sized chip or piece from its surrounding substrate material. This technique is similar to a method of applying pressure sensitive adhesive labels from a release liner. The separated chip or piece is provided to a first station of the rotary table. Alternatively, the "breaking" can be accomplished in a pre-station.).

The first station positions a card-sized laminate piece (e.g., obtained from a magazine or supply of such laminate pieces) with its adhesive side facing upward up, so that the printed substrate chip can be provided on top of the laminate. The chip is placed on top of the laminate so as to contact the adhesive side of the laminate piece with a bottom side of the chip. The chip and laminate are provided to a second station.

The second station picks a card-sized laminate piece and places an adhesive side of the laminate piece to contact a top side of the chip. The laminate-chip-laminate structure forms a chip sandwich that is provided to a third station.

A third station closes a platen cover on top of the chip sandwich. (In some case the sandwich is placed on a bottom platen cover. However, a bottom platen cover is generally not needed since subsequent stations will often include a station nest having a fixed bottom platen cover.).

In a fourth station, a heated platen press closes on the platen top (and perhaps bottom, if provided) cover to heat and press the chip sandwich together.

In the fifth station, a cooling press closes on or around the top (and perhaps bottom, if provided) platen plate, cooling the chip sandwich.

In a sixth station, the platen covers are opened.

In an optional seventh station, the cooled ID card is magnetic stripe encoded.

And in an eighth station, a finished card is ejected from the rotary table. Of course, the card can alternatively be ejected after the platen covers open (station 6), or after the magnetic stripe is encoded (station 7).

While this approach has multiple steps, it does have the advantage of eliminating a cutter. An alternative might be to introduce precut laminate pieces from a carrier web where the laminate pieces are attached to the carrier with low bond strength adhesive such that the pieces could be "label fed" from the carrier onto the table. We also note that some of the above mentioned stations can be combined, such as stations 1 and 2, and 5 and 6.

Embodiment 9

Semi-Automated Process

Manual intervention can be used to simplify our inventive processes. Such semi-automated systems with typically use one or two ink jet printers, a belt laminator, a manual die cutter and, optionally, a magnetic stripe encoder. Consider the following inventive process.

An operator places a substrate sheet in a printer sheet feeder of a first ink jet printer. The first ink jet printer applies the desired printing to a first side of the substrate sheet. The sheet is then conveyed into a feed tray of a second ink jet printer in a manner that presents a second side of the sheet to the printer. We note that either the operator or a conveyance path (e.g., path 203) can present the substrate sheet to the second printer. The second ink jet printer applies the desired printing to the reverse side of the sheet. (As an alternative, we note that a single printer system can be used as described above with respect to FIG. 5.)

The operator removes the printed substrate and places it between pieces of front and back laminate. Alternatively, the operator slips the printed substrate into a so-called lamination pouch. The operator then introduces the stack of materials (e.g., laminate-substrate-laminate) onto a laminator where the stack is heated, cooled and then fed out of the laminator. The operator then places the laminated stack into a hand cutter, and cuts the finished card.

In an alternative implementation, only a subset of the above manual operations is manually carried out, while the remaining operations are automated.

A matte finish on the outside surfaces of the laminates can be provided to help prevent air bubble between a laminator (e.g., a gloss finish laminator belt) and the laminate. Of course, a belt laminator can be replaced with a roll laminator as discussed above with respect to FIGS. 4-8. Again a matte finish on the outside surfaces of the laminates may help prevent air bubbles.

Embodiment 10

Injection Molding Process

An injection molding process is used as an alternative to the above described lamination processes.

Either a single or dual printing system is used to print a substrate sheet as described above with respect to FIGS. 4-8. The printed substrate sheet is then placed into an open mold including, e.g., two halves. The mold halves close over the printed substrate sheet and polymer (or other protective coating) is injected into the mold, preferably on both sides of the substrate sheet. (We note that the polymer is ideally thermoplastic or thermoset to avoid undue shear forces to the substrate due to viscosity.) At the end of the molding cycle, the mold is opened and the molded substrate is removed. The substrate that extends beyond the polymer edge, if any, can be removed with cutting. Those skilled in the art will further appreciate that other methods of injection molding are, of course, usable.

CONCLUDING REMARKS

Having described and illustrated the principles of the technology with reference to specific implementations, it will be recognized that the technology can be implemented in many other, different, forms, and in many different environments.

For example, we note that our preferred laminate material is polymer-based and typically softens at a temperature required to soften and activate a laminate adhesive. This softening point is an excellent feature in a finished ID card because it makes tampering with the card evident due to the stretching and distortion of the laminate that occurs when heat is used to try to remove the laminate. Accordingly, a laminator will sometimes deal with the stretching and distortion aspect and, therefore, we have introduced the concepts of belts, cooling rollers or special pouch carriers. Of course, these elements can be simplified if laminates, which use a base polymer that does not soften at the adhesive laminating temperature, are used instead. The tradeoff, however, is that tamper resistance of a finished card will likely be inferior.

While we have provided specific temperature ranges by way of example, the invention is not limited to such. Indeed, the adhesive activation temperature and the adhesive bonding temperatures mentioned can be changed depending on the adhesive material used, the laminate material used, and so on. Similarly, while we have provided some specific dimensions for the card and laminate material, the present invention is not limited to such. Dimensional changes can be made without deviating from the scope of our invention.

While we have provided specific dimensions by way of example, the invention is not limited to such dimensions.

We note that a substrate sheet, e.g., TESLIN, can be treated to better receive ink jet printing as discussed in assignee's U.S. Provisional Patent Application No. 60/344,685 and copending U.S. Nonprovisional patent application Ser. No. 10/289,962. We also note and expressly contemplate that the techniques and pigmented ink disclosed in these applications can be combined with the inventive features of the present application.

To provide a comprehensive disclosure without unduly lengthening the specification, applicant herein incorporates by reference each of the U.S. patent documents referenced above.

The particular combinations of elements and features in the above-detailed embodiments are exemplary only; the interchanging and substitution of these teachings with other teachings in this and the incorporated-by-reference patent documents are also expressly contemplated.

Further, although certain words, languages, phrases, terminology, and product brands have been used herein to describe the various features of the embodiments of the invention, their use is not intended as limiting. Use of a given word, phrase, language, terminology, or product brand is intended to include all grammatical, literal, scientific, technical, and functional equivalents.

As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto.

What is claimed is:

1. A system to assemble identification documents, said system comprising:

a first ink jet printer operable to print first information on a top surface of a substrate sheet, said first ink jet printer including a print tray or input to receive the substrate sheet;

a conveyor to convey the once printed substrate sheet from the first ink jet printer;

a feed tray operatively associated with a second ink jet printer to receive the once printed substrate sheet from the conveyor, the once printed substrate sheet being conveyed to the feed tray to invert the substrate sheet and to position a bottom surface of the substrate sheet to receive second information from the second ink jet printer, the second ink jet printer being operable to print the second information on the bottom surface of the substrate sheet;

a second conveyor to convey a twice-printed substrate sheet from the second ink jet printer to a laminator; the laminator operable to receive the twice printed substrate sheet and to provide a top laminate in contact with the top surface of the twice printed substrate sheet and a bottom laminate in contact with the bottom surface of the twice printed substrate sheet, the laminator to laminate the top laminate to the top surface of the twice printed substrate sheet and to laminate the bottom laminate to the bottom surface of the twice printed substrate sheet, wherein at least one of the substrate, top laminate and bottom laminate includes a magnetic stripe;

a cutter to cut excess material from the laminated, twice printed substrate sheet, the cut, laminated twice printed substrate sheet forming the identification document;

a magnetic stripe encoder to encode data in the magnetic stripe; and at least one of a scrap material collector to collect residual scrap material, a shedder to shred residual scrap material, a stacker to stack residual stack material, and a rewinder to rewind residual scrap material.

2. A system to assemble identification documents, said system comprising:

a first ink jet printer operable to print first information on a top surface of a substrate sheet, said first ink jet printer including a print tray or input to receive the substrate sheet;

a conveyor to convey the once printed substrate sheet from the first ink jet printer;

a feed tray operatively associated with a second ink jet printer to receive the once printed substrate sheet from the conveyor, the once printed substrate sheet being conveyed to the feed tray to invert the substrate sheet and to position a bottom surface of the substrate sheet to receive second information from the second ink jet printer, the second ink jet printer being operable to print the second information on the bottom surface of the substrate sheet;

a second conveyor to convey a twice-printed substrate sheet from the second ink jet printer to a laminator; the laminator operable to receive the twice printed substrate sheet and to provide a top laminate in contact with the top surface of the twice printed substrate sheet and a bottom laminate in contact with the bottom surface of the twice printed substrate sheet, the laminator to laminate the top laminate to the top surface of the twice printed substrate sheet and to laminate the bottom laminate to the bottom surface of the twice printed substrate sheet, wherein at least one of the substrate, top laminate and bottom laminate includes a magnetic stripe;

a cutter to cut excess material from the laminated, twice printed substrate sheet, the cut, laminated twice printed substrate sheet forming the identification document, wherein said cutter comprises at least one of a blanking die cutter, laser cutter, a rotary die cutter and a steel rule die cutter; and a magnetic stripe encoder to encode data in the magnetic stripe.

3. A system to intermittently assemble identification documents, said system comprising:

a first ink jet printer operable to print first information on a top surface of a substrate sheet, said first ink jet printer including a print tray or input to receive the substrate sheet;

a conveyor to convey the once printed substrate sheet from the first ink jet printer;

a feed tray operatively associated with a second ink jet printer to receive the once printed substrate sheet from the conveyor, the once printed substrate sheet being conveyed to the feed tray to invert the substrate sheet and to position a bottom surface of the substrate sheet to receive second information from the second ink jet printer, the second ink jet printer being operable to print the second information on the bottom surface of the substrate sheet;

a second conveyor to convey a twice-printed substrate sheet from the second ink jet printer to a laminator; the laminator operable to receive the twice printed substrate sheet and to provide a top laminate in contact with the top surface of the twice printed substrate sheet and a bottom laminate in contact with the bottom surface of the twice printed substrate sheet, the laminator to laminate the top laminate to the top surface of the twice printed substrate sheet and to laminate the bottom laminate to the bottom surface of the twice printed substrate sheet, wherein the laminator comprises a top laminate supply and at least a laminator roller to heat and press the top laminate obtained from the top laminate supply to the top surface of the twice printed substrate sheet, and wherein the laminator further comprises a bottom laminate supply and at least a laminator roller to heat and press the bottom laminate obtained from the bottom laminate supply to the bottom surface the twice printed substrate sheet, the bottom laminator roller being relatively positioned below the top laminator roller, and wherein the top laminate and bottom laminate each comprise an individual sheet of lamination material, said top laminate and bottom laminate being respectively carried by a top carrier web and a bottom carrier web, wherein the top carrier web comprises a top opening and the top laminate is positioned over the top opening, and wherein the bottom carrier web comprises a bottom opening and the bottom laminate is positioned over the bottom opening;

a cooler to receive a recently laminated twice printed substrate sheet, wherein the cooler comprises at least one of a plurality or rollers, a cooling belt and a heat sink; and a cutter to cut excess material from the laminated, twice printed substrate sheet, the cut, laminated twice printed substrate sheet forming the identification document.

4. The system of claim 3, further comprising a pair of pulling rollers to pull the carrier web through the laminator and cooler.

5. The system claim 3, wherein each of the top carrier web and bottom carrier web includes a plurality of form feed holes, and said system further comprises a pin belt including a plurality of pins to engage at least one of the top form feed holes and bottom form feed holes.

6. The system of claim 5, wherein the plurality of pins to engage the at least one of the top form feed holes and the bottom form feed holes serves to transport at least one of the top carrier web and bottom carrier web through the laminator and cooler as the pin belt moves.

7. The system of claim 5, wherein the plurality of pins to engage the at least one of the top form feed holes and the bottom form feed holes serves to transport the carrier web including the laminated substrate sheet to the cutter as the pin belt moves.

8. The system of claim 7, wherein the plurality of pins to engage the at least one of the top form feed holes and the bottom form feed holes serves to align the carrier web in the cutter.

9. The system of claim 5, wherein the substrate sheet includes a plurality of form feed holes.

10. The system of claim 9, wherein the form feed holes of the substrate sheet and at least one of the top carrier web form feed holes and bottom carrier web form feed holes are aligned to register the substrate with respect to at least one of the top laminate and bottom laminate.

* * * * *